US007298860B2

(12) United States Patent
Engebretson et al.

(10) Patent No.: US 7,298,860 B2
(45) Date of Patent: Nov. 20, 2007

(54) RIGGING SYSTEM FOR LINE ARRAY SPEAKERS

(75) Inventors: Mark Engebretson, Encino, CA (US); Yoshiyuki Takeuchi, Pine Mountain Club, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 602 days.

(21) Appl. No.: 10/407,081

(22) Filed: Apr. 3, 2003

(65) Prior Publication Data

US 2003/0231782 A1 Dec. 18, 2003

Related U.S. Application Data

(63) Continuation-in-part of application No. 09/921,095, filed on Jul. 31, 2001, now abandoned.

(60) Provisional application No. 60/300,372, filed on Jun. 22, 2001, provisional application No. 60/222,026, filed on Jul. 31, 2000.

(51) Int. Cl.
*H04R 25/00* (2006.01)

(52) U.S. Cl. ..... 381/386; 381/87; 381/335

(58) Field of Classification Search ..... 181/144, 181/199; 381/87, 182, 184, 186, 300, 304, 381/332, 335–336, 386; 248/221.11, 282.1, 248/323, 687

See application file for complete search history.

(56) References Cited

U.S. PATENT DOCUMENTS 3,778,562 A * 12/1973 Wright ..... 381/335
4,660,728 A * 4/1987 Martin ..... 211/118
4,845,759 A 7/1989 Danley
5,590,214 A * 12/1996 Nakamura ..... 381/182
5,602,366 A * 2/1997 Whelan et al. ..... 181/144
5,749,137 A * 5/1998 Martin ..... 29/434
5,758,852 A * 6/1998 Martin ..... 248/282.1
5,819,959 A * 10/1998 Martin ..... 211/118
5,833,186 A 11/1998 Kosmoski
5,947,434 A 9/1999 Kosmoski
5,996,728 A * 12/1999 Stark ..... 181/144
6,016,353 A * 1/2000 Gunness ..... 381/342
6,095,279 A 8/2000 Adamson
6,112,847 A 9/2000 Lehman
6,640,924 B2 * 11/2003 Messner ..... 181/144
6,652,046 B2 * 11/2003 Christner ..... 312/111
6,810,127 B2 * 10/2004 Bronson, III ..... 381/345
2002/0071580 A1 * 6/2002 Engebretson et al. ..... 381/182
2003/0127280 A1 * 7/2003 Engebretson ..... 181/199

(Continued)

OTHER PUBLICATIONS

Article entitled "JBL Vertec Line Array System" by Mark Frink, published Oct. 2000 in Mix Magazine.

(Continued)

*Primary Examiner*—Melur Ramakrishnaiah
*Assistant Examiner*—Phylesha L Dabney

(57) ABSTRACT

The invention provides a system for enabling the assembly and suspension of a plurality of loudspeakers in a line array where the splay angle between the adjacent speakers can be adjusted and rigidly maintained. The line array system utilizes rigging frames that allow for the coupling and supporting of the loudspeakers through the use of adjustable hinge bars. The rigging frames and adjustable hinge bars together form and rigidly maintain the splay angles between adjacent loudspeakers and correspondingly the curvature of the line array speaker assembly.

43 Claims, 15 Drawing Sheets

U.S. PATENT DOCUMENTS

2004/0131217 A1* 7/2004 Opie et al. ..... 381/336
2004/0213425 A1* 10/2004 Simidian et al. ..... 381/335
2004/0218773 A1* 11/2004 Andrews ..... 381/335
2005/0008165 A1* 1/2005 Sack et al. ..... 381/59
2005/0201583 A1* 9/2005 Colich ..... 381/335
2005/0232455 A1* 10/2005 Monitto et al. ..... 381/335

OTHER PUBLICATIONS

Article entitled "Conventional Wisdom Challenged" by Paul Meserve, published Sep./Oct. 2000 in Live Sound!.

* cited by examiner

RIGGING SYSTEM FOR LINE ARRAY SPEAKERS

CROSS-REFERENCES TO RELATED APPLICATIONS

This application is a continuation-in-part of U.S. patent application Ser. No. 09/921,095, filed Jul. 31, 2001 now abandoned, that claims priority to U.S. provisional application Ser. No. 60/300,372, filed Jun. 22, 2001, and U.S. provisional application Ser. No. 60/222,026, filed Jul. 31, 2000, and are incorporated by reference.

BACKGROUND OF THE INVENTION

1. Field of the Invention

This invention relates to a rigging system for line array speakers. In particular, the invention relates to a system of assembling and suspending a plurality of line array speakers and adjusting the splay angle between the speakers to control and produce the desired sound radiation.

2. Related Art

A line array is a group of often similarly sized speakers positioned adjacent to one another to optimize sound level output over a larger coverage area. Line array speaker systems are often used in large venues, such as auditoriums and concert halls, where it is desirable to reproduce a high sound level across a wide coverage area. Line array speakers provide increased directivity at various frequencies. Providing increased directivity at various frequencies extends the near-field coverage area because the coverage distance from the near field to the far field transition zone is increased with frequency. The ability of line array speaker systems to increase near field extension is well known in the art. For this reason, line arrays offer significant advantages over traditional multi-box sound systems and are preferred for use in large venues.

To achieve an optimal sound level over a desired coverage area, line arrays are strategically positioned in various places, at varying heights and angles, throughout a venue. The positioning of the line arrays is determined by using simple equations that anticipate the performance of differently sized speakers based upon their arrangement relative to one another. The specific height of a line array and angle and spacing between the speakers in the line array are the main variables that govern the sound level output and coverage area of the line array. The height of an array governs the line array's directivity. The spacing of the individual speakers, which is a second-order effect, determines the lobing structure of the line array. For example, a relatively straight array may radiate the sound level desired for far field coverage. For near field coverage, the line arrays often require some degree of curvature to provide uniformity of coverage over a wider vertical angle.

Once the optimal speaker arrangement for a given venue is determined, the speakers in the line arrays are then typically arranged and mounted on specially designed racks. Depending upon the desired arrangement, the line arrays are then suspended in the air with hanging equipment and/or placed on the ground. By properly arranging the line array speakers and articulating or curving the line array in the vertical plane at a specific angle, one can provide excellent coverage for listeners seated in both the near and the far fields.

Despite the advantages that line arrays can provide over traditional multi-box sound systems, there are notable disadvantages with the known line array based systems. With conventional systems, it has been difficult to adjust and maintain the splay angle between adjacent speakers. Maintaining the angles between the line array speakers, and thereby the overall curvature of the line array system, is important to the performance of the sound system. This is especially true when the line arrays are configured for large venues having more than one seating plane. With the presence of more than one seating plane, curvature becomes very important to providing uniformity of coverage and the line arrays are often suspended in the air. Depending on the particular seating arrangement, the speakers must be deployed precisely and maintained at specific vertical angles to avoid phase interference between the sounds from the adjacent loudspeakers. With the current line array systems, it has been difficult to maintain the overall integrity of the line array once suspended in the air. The conventional systems are not truly 'rigid' in that the specific angles between the speakers cannot be maintained constant when the system is suspended or otherwise manipulated.

Another problem associated with the current line array systems is the difficulty of assembling, suspending and adjusting the plurality of loudspeakers in an array to the desired configuration. Presently, substantial, elaborate preparation and labor are required to assemble and install line array systems. The installation time and cost become significant, especially in large-scale operations, which can require many line arrays.

Another disadvantage of the conventional systems relates to the transportation of the line array systems from one location to another. The dimensions of the line array system play a significant role in determining the number of transportation vehicles needed, and consequently has a significant impact on transportation and operation costs. Many conventional sound systems utilize loudspeakers with associated frames that are more than 48 inches wide. Thus, it is impossible to vertically double stack the line array speakers with frames in an industry standard transportation type truck, which has about a 96 inch vertical cargo height. Most systems known in the art are designed without the dimensional considerations in mind to ease the actual practice of loading and transporting the systems.

Therefore, a need exists for line array speakers that are easy to assemble, transport, and suspend. In addition, a need exists for a line array system having the ability to adjust and rigidly maintain the curvature of the line array system and the splay angle between adjacent speakers.

SUMMARY

According to one implementation, a system is provided for assembling and suspending line array loudspeakers. The system further provides for the splay angles between the speakers to be easily adjusted and rigidly maintained. The line array system utilizes rigging frames that are attached to both sides of each speaker in the line array. The speakers are then coupled to one another with hinge bars that attach to and extend between the rigging frames of the speakers. The hinge bars not only support the loudspeakers but can also be easily adjusted to position the speakers at various angles relative to one another. The rigging frames and associated connecting hinge bars together form and rigidly maintain the splay angles between the speakers and correspondingly the curvature of the line array.

According to another implementation, to form the line array, each speaker in the line array has a rigging frame attached on the left and right sides of the speaker housing. The rigging frames on each side of the speaker housing may then be coupled together with the rigging frames of adjacent speakers, such that the right rigging frame of one speaker may be coupled together with the right rigging frame of an adjoining speaker. The rigging frames are coupled to one another by front and rear hinges.

According to another implementation, the front of the speakers in the line array are pivotally coupled together by the front hinges of the rigging frames and remain juxtaposed with respect to one another. The rear hinges are, however, adjustable and determine the splay angle between the speakers. The rear hinges can attach to the rigging frames at various points along the hinge. Thus, the angle between the speakers can be increased and decreased by connecting the rear hinges to the rigging frames at different points along the length of the hinge. The more hinge that is exposed when connected, the greater the angle between the two adjacent speakers. The curvature of the line array system as a whole may be articulated based on the splay angles between the speakers. Thus, the splay angles between the speakers in the line array system may be adjustable to create the desired curvature and to provide smooth, even sound coverage to both near and far seating areas.

According to another implementation, once coupled, the line array may be either suspended in the air or stacked on the ground using one or more line array frames. Dollies and wheels may be coupled to each speaker for ease in moving and assembling the line array system.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood with reference to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
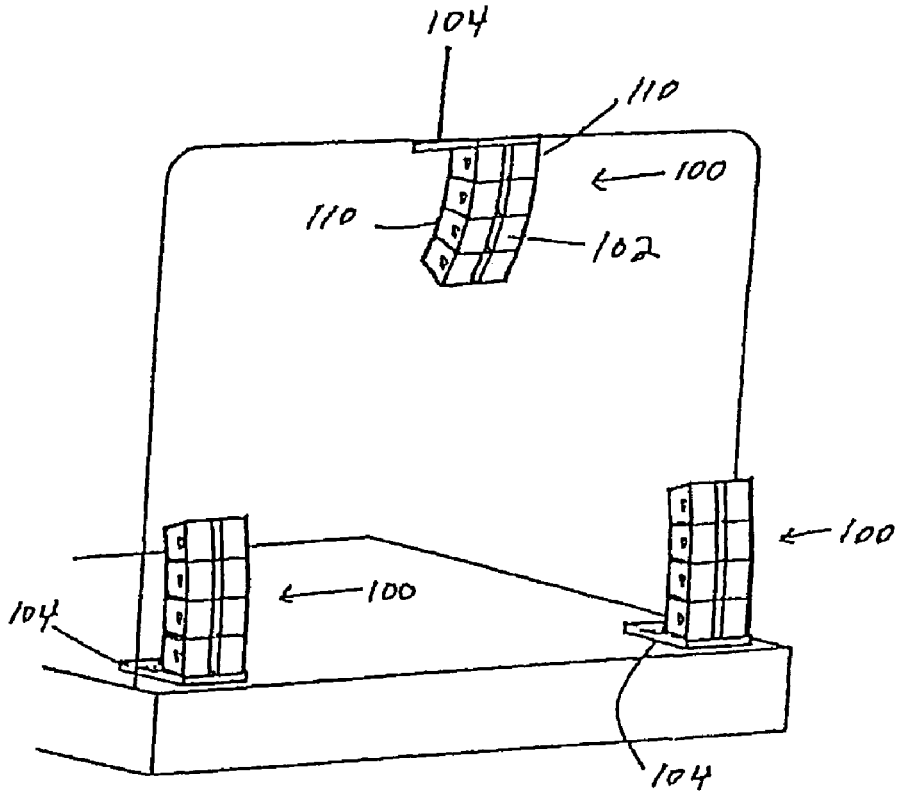
FIG. 1 is a perspective view depicting various deployments of line array systems as they would appear positioned on a sound stage.

FIG. 1 illustrates a number of line array speaker systems 100 positioned on the ground, on the left and right sides of a sound stage, and suspended above the center of the sound stage. As seen in FIG. 1, each line array 100 also includes an array frame 104 that is used to hoist the line array 100 in the air or that may be used as a base support when stacked on the ground. Each line array 100 includes a plurality of line array speakers 102. As described in more detail below, respective rigging frames 110 are mounted to the left and right sides of each line array speaker 102. Both the air-suspended and the ground stacked line array systems 100 may be articulated or curved to achieve the optimum sound radiation to a predetermined area.

Figure 2:
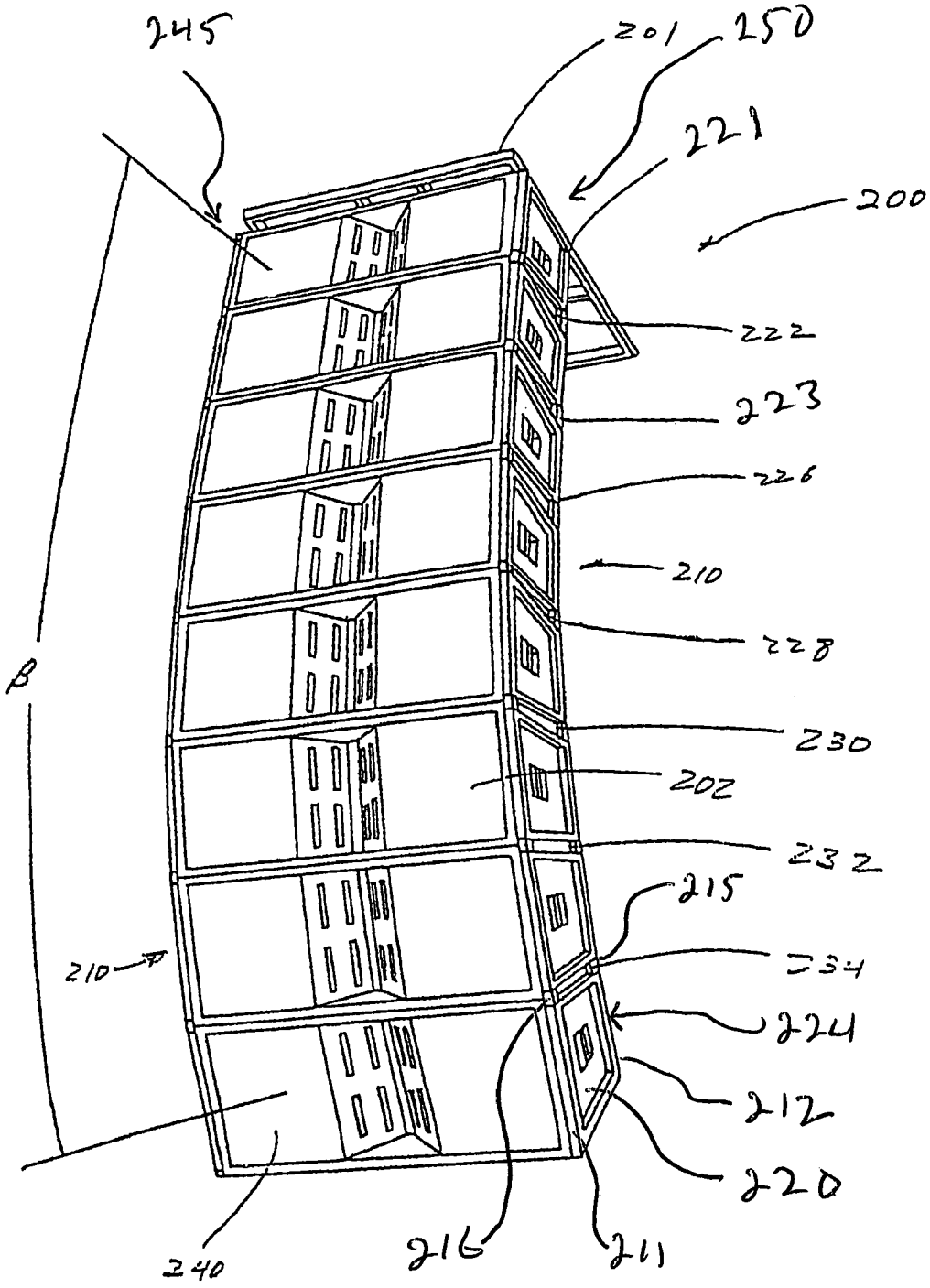
FIG. 2 is a perspective view illustrating an example line array speaker system.

FIG. 2 is a perspective view of a hanging line array speaker system 200 and illustrates the positioning of the rigging frames 210 as they would appear on the side of each line array speaker 202 in the line array system 200. To form the line array system 200, each speaker 202 in the line array 200 has a rigging frame 210 coupled on the left side 245 and right side 250 of the speaker housing 220. Although the rigging frames 210 can only be seen fully on one side of the line array speakers 202 in FIG. 2, the rigging frames 210 are positioned on both the left and right sides 245 and 250 of the array speakers 202. The respective rigging frames 210 may be coupled to the speaker housings 220 with machine screws set into four pads on each end of the speakers 202 (i.e., on the left side 245 and right side 250 of each speaker 202), or other like method of securely fastening the rigging frames 210 to the speaker housings 220.

As seen in FIG. 2, each rigging frame 210 has a front side 211 and a rear side 212, and is substantially trapezoidal in shape. Alternatively, the rigging frames 210 may have other shapes as well, such as triangular, rectangular, etc. To form the trapezoidal shape, the front side 211 is longer than the rear side 212. Likewise, the speaker housing 220 on the left and right sides 245 and 250 generally forms a trapezoidal shape, such that the front surface 240 of the speaker housing 220 is taller than the back surface 224.

The rigging frames 210 on each side of the speaker housing 220 may then be coupled together with the rigging frames 210 of adjacent speakers 202, such that the right rigging frame 210 of one speaker 202 may be coupled together with the left rigging frame 210 of an adjoining speaker 202. The rigging frames 210 are coupled to one another by front hinges or hinge bars 216 and rear hinges or hinge bars 215 that attach to and extend between the rigging frames 210 of the speakers 202. The hinge bars 216 and 215 not only support the loudspeakers 202 but can also be easily adjusted, as further explained below, to position the speakers 202 at various angles relative to one another. The rigging frames 210 and associated connecting hinge bars 216 and 215 together form and rigidly maintain the splay angles between the speakers 202 and correspondingly the curvature of the line array 200. Both the rigging frames 210 and the front and rear hinges 216 and 215 may be made of heat-treated 4130 premium steel alloy, or other like material.

As seen in FIG. 2, the line array system 200 may have a predetermined curvature β to provide uniformity of coverage over a wider vertical angle. The curvature β is a summation of all the splay angles on the backside of adjacent array speakers 202. For instance, if the first splay angle 221 between the first array speaker 202 and array frame 201 is set at 0°, and each of the corresponding splay angles 222, 223, 226, 228, 230, 232, and 234 are set at 2°, 2°, 2°, 4°, 4°, 4°, and 6°, respectively, then the curvature β is 24°. Note that the overall front surface 240 of the line array system 200 is continuous. For example, the front surfaces 240 of adjacent array speakers 202 are substantially flush against each other and there is a little gap, if any, between the two speakers 202 at their front surfaces 240.

Figure 3:
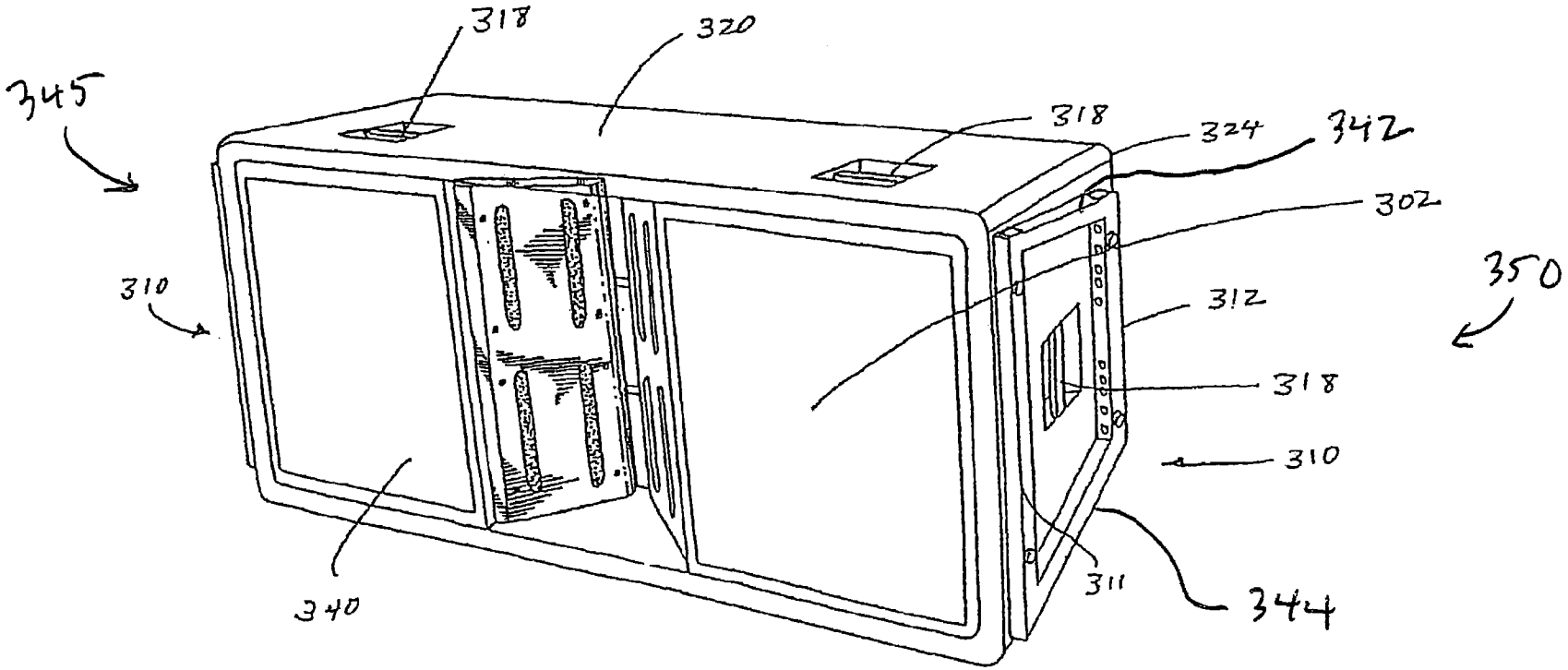
FIG. 3 is a perspective front view of a line array speaker.

FIG. 3 is a perspective front view of a typical speaker 302 used in a line array system 100 or 200. FIG. 3 illustrates the coupling of the rigging frames 310 on the left and right sides 345 and 350 of the speaker 302. FIG. 3 also illustrates the substantially trapezoidal shape of the rigging frames 310 and the speaker housing 320 and depicts the front and rear sides 311 and 312 of the rigging frames 310. The front side 311 and opposing rear side 312 of each rigging frame 310 are adjoined by opposing lateral sides 342 and 344 of the rigging frame 310. To assist in handling the speaker 310, the speaker housing 320 may also include handles 318.

Figure 4:
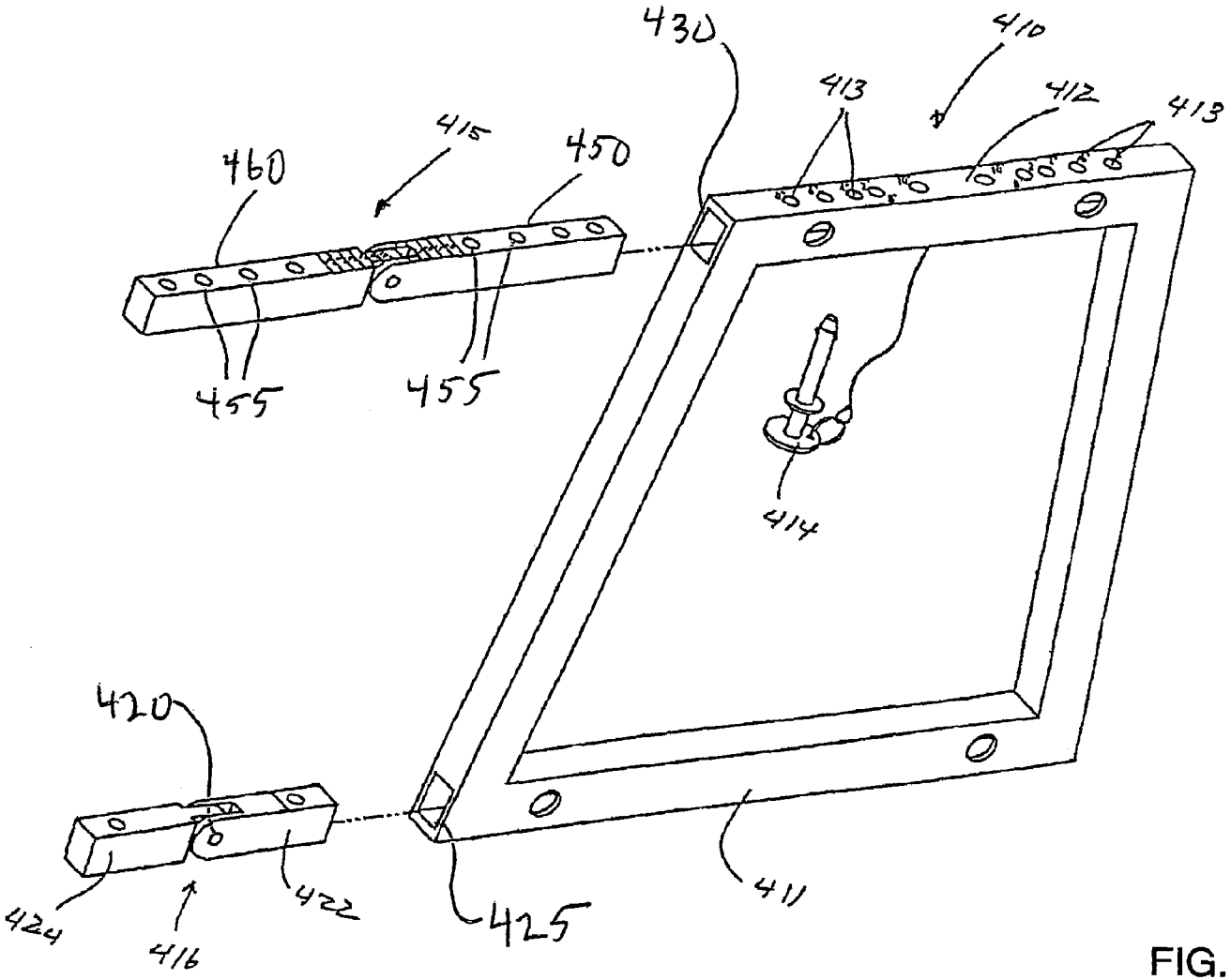
FIG. 4 is a perspective view of the rigging frame and front and rear hinge bars.

FIG. 4 is a perspective view of a rigging frame 410, and a front hinge bar 416 and rear hinge bar 415. As previously noted, the front hinge bar 416 and the rear hinge bar 415 are utilized to couple the adjacent rigging frames 410 to one another. As illustrated by FIG. 4, the front side 411 of the rigging frame 410 is adapted to slidably receive the front hinge bar 416, and the rear side 412 is adapted to slidably receive the rear hinge bar 415. The front hinge bar 416 is smaller in length than the rear hinge bar 415, and is designed to pivotally couple two adjacent front sides 411 about a pivot point 420. The pivot point 420 is provided to allow the front surfaces 240 of the speakers 202 of a line array 200 (see FIG. 2) to move relative to one another as the splay angles of the speakers 202 are adjusted.

The front hinge bar 416 has a first arm 422 and a second arm 424 coupled to one another at the pivot point 420. The first arm 422 of the front hinge bar 416 may be slidably inserted into an opening 425 in the front side 411 of the rigging frame 410 and releasably locked in place. Similarly, the second arm 424 of the front hinge bar 416 may be slidably inserted into an opening in the front side 411 of an adjacent rigging frame 410 and releasably locked in place. As a result, in a line array such as the line array 200 shown by example in FIG. 2, the two adjacent front sides 211 of two adjacent rigging frames 210 are coupled so that the front surfaces 240 of two adjacent speakers 202 are substantially flush with one another. Referring back to FIG. 4, the front hinge bars 416 may be captive in the adjacent front sides 411 with a small thumb, or slider knob (not shown) threaded through holes in the front hinge bar 416 (e.g., holes in the corresponding arms 422, 424) aligned with holes in the rigging frame 410 after the front hinge bar 416 is fitted into the front side 411 of the rigging frames 410. Moreover, the front hinge bar 416 may be locked into the rigging frame 410 with a release pin (not shown, but see pins 1417 in FIG. 14), similar to the release pin 414 illustrated in FIG. 4 for use in connection with the rear side 412 of the rigging frames 410. The release pins may also provide a means of storage for the front hinge bars 416 so that they do not get lost or misplaced.

Similar to the front hinge bar 416, the rear hinge bar 415 has a first arm 450 and a second arm 460. The first arm 450 of the rear hinge bar 415 may be slidably inserted into an opening 430 in the rear side 412 of the rigging frame 410 and releasably locked in place. Likewise, the second arm 460 of the rear hinge bar 415 may be slidably inserted into an opening 430 in the rear side 412 of an adjacent rigging frame 410 and releasably locked in place. As a result, the two adjacent rear sides 412 are releasably coupled to one another. The rear hinge bars 415 may be captive in the adjacent rear sides 412 with a release pin 414, which allows the positioning of the rear hinge bars 415 within the rear sides 412 of the rigging frame 410 to be easily adjusted. Unlike the front hinge bar 416, the rear hinge bar 415 has a plurality of bores 455 as well as incremental marking of degrees, ranging from 0 to 10-degrees, in 2-degree increments. Similarly, the rear side 412 of the rigging frame 410 has a plurality of openings 413, each hole 413 marked with a specific numeric angle. By aligning the different bores 455 of the rear hinge bar 415 with different openings 413 in the rear side 412 of the rigging frame 410, the angular relationship, or the splay angles, between adjacent line array speakers 202 in a line array 200 (see FIG. 2) may be adjusted at angles of 0 to 10-degrees. The incremental degree markings on the rear hinge bar 415 and the markings on the openings 413 on the rear side 412 of the rigging frame 410 indicate the splay angle between the line array speakers 202 (FIG. 2) when corresponding bores 455 in the rear hinge bar 415 are aligned with the various openings 413 in the rear side 412 of the rigging frame 410.

Figure 5:
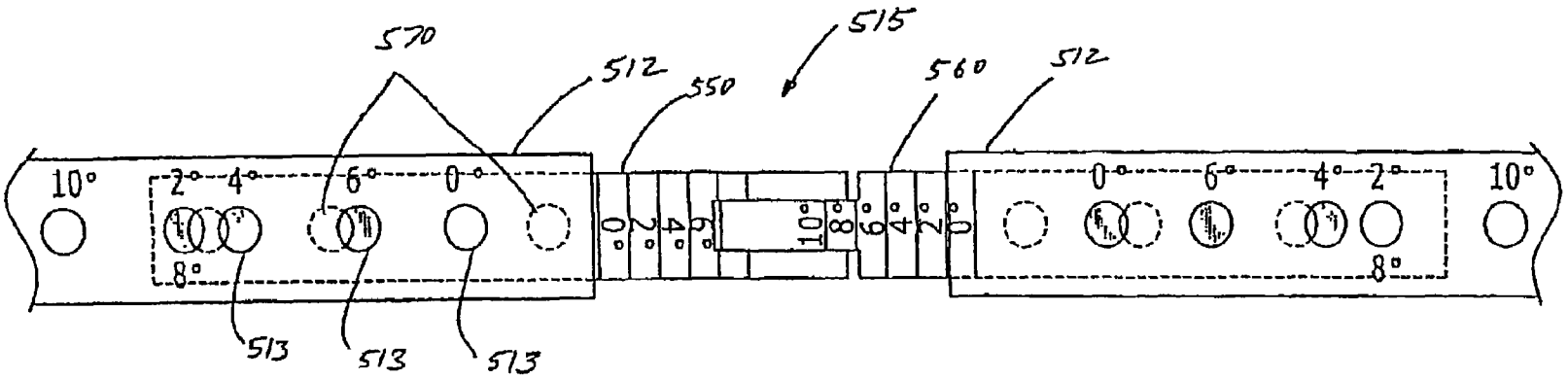
FIG. 5 is a side view of a rear hinge bar inserted between adjacent rigging frames.

FIG. 5 is a side view of a rear hinge bar 515 inserted between adjacent rigging frames 410 (FIG. 4) and illustrates how the rear hinge bar 515 and rear side 512 of the rigging frame 410 are both marked with specific numeric angles to adjust and gauge the splay angle of the speakers 202 (FIG. 2). In FIG. 5, each of the two arms 550 and 560 of the rear hinge bar 515 may be adapted such that the rear hinge bar 515 can be inserted into the rear sides 512 of the rigging frames 410. As seen in FIG. 5, the plurality of bores 570 in the two arms 550 and 560 of the rear hinge bar 515 may be aligned with any of the openings 513 in the rear side 512 of the rigging frame 410 and secured against the rigging frame 410 by a release pin 414, shown in FIG. 4, positioned through the aligning bores 570 and openings 513. Depending upon which opening 513 the bore 570 is aligned with, the splay angle may be set at 2-degree or 1-degree increments. As explained in more detail below, the markings on both the arms 550 and 560 and the rear side 512 of the rigging frame 410 indicate at which point the connection between the rear side 512 of the rigging frame 410 and the arms 550, 560 should be made to achieve the desired splay angle. The bores 570 in the rear hinge bar 515 and the openings 513 in the rear side 512 of the rigging frame 410 both represent coupling or connection points at which the rear hinge bar 515 and the rigging frame 410 may be coupled to one another.

Figure 6:
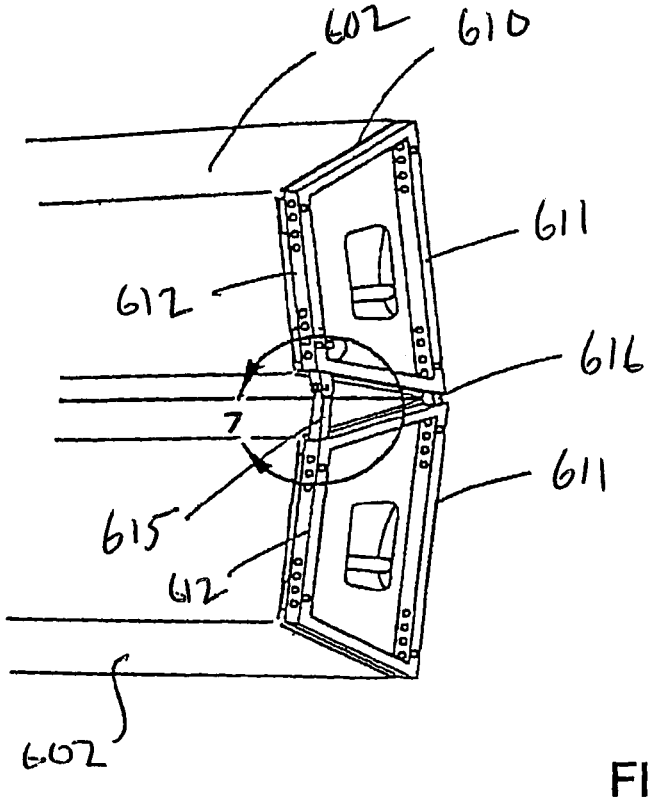
FIG. 6 is a perspective view depicting the connection of two adjacent line array speaker units.

FIG. 6 is a perspective view illustrating the coupling of two adjacent line array speakers 602 and demonstrates in more detail how the rear hinge bars 615 may be utilized to adjust the splay angle between two adjacent line array speakers 602. The front hinge bar 616 may be first slidably disposed in the front side 611 of the rigging frame 610 and then pivotally coupled to the front side 611 of an adjacent rigging frame 610. Once coupled, the front sides 611 of the two adjacent rigging frames 610 remain juxtaposed without a substantial gap. Unlike the rear hinge bar 615, the front hinge bar 616 is designed to be disposed at one fixed position within the front sides 611 of the rigging frame 610. In addition, once coupled together by the front hinge bar 616, the front sides 611 of the opposing rigging frames 610 remain at the coupled position while the line array 200 (FIG. 2) is assembled, suspended, ground-stacked or otherwise manipulated.

Figure 7:
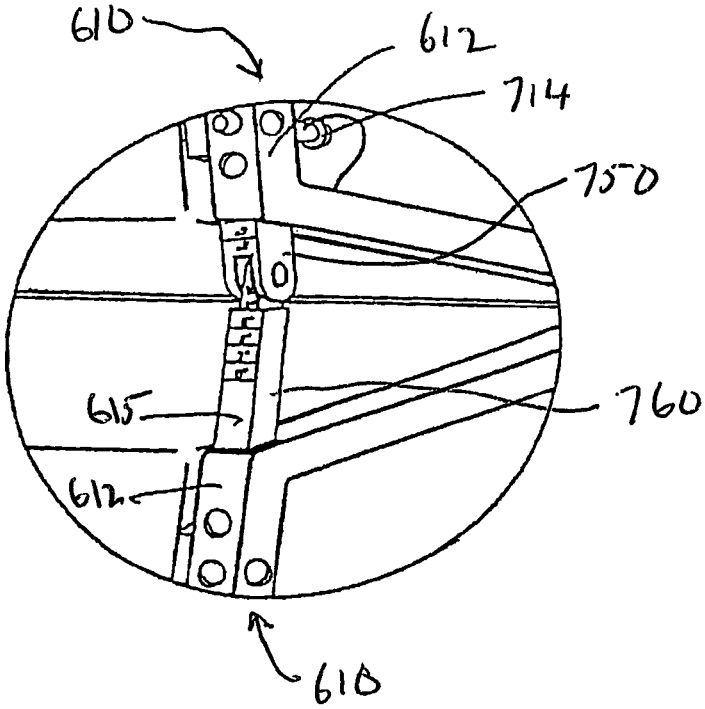
FIG. 7 is an enlarged view of the portion in FIG. 6 showing the rear hinge bar coupling the rear sides of the adjacent rigging frames.

FIG. 7 is an enlarged view of an encircled area in FIG. 6 showing how the rear hinge bar 615 couples the adjacent rear sides 612 of the rigging frames 610, and shows how each arm 750 and 760 of the rear hinge bar 615 is inserted into the adjacent rear sides 612. In FIG. 7, the splay angle between the adjacent rigging frames 610 is adjusted by inserting the release pin 714 at a desired angle position. Again, by adjusting the predetermined distance between the adjacent rear sides 612 of the adjacent rigging frames 610, the splay angle of the speakers 602, and the curvature of the line array system 200 (FIG. 2) is established. For instance, to set the splay angle at 4-degrees, each of the arms 750 and 760 may be slidably inserted into openings in the opposing rear sides 612 of adjacent rigging frames 610 until the 4-degree marking shows on both arms 750 and 760. At this position, the 4-degree opening on the rear side 612 aligns with one of the bores in the arm 750 so that a pin 714 may be inserted through the opening and the bore to couple the arm 750 to the rear side 612. To set the splay angle at 1-degree, one arm 750 is inserted into the rear side 612 until the 2-degree marking shows and the other arm 760 is inserted into the rear side 612 until the 0-degree marking shows. Again, the front hinge bar 616 and the rear hinge bar 615 may be stored inside of the rigging frames 610 via release pins 714 to avoid losing, misplacing or carrying loose parts.

Figure 8:
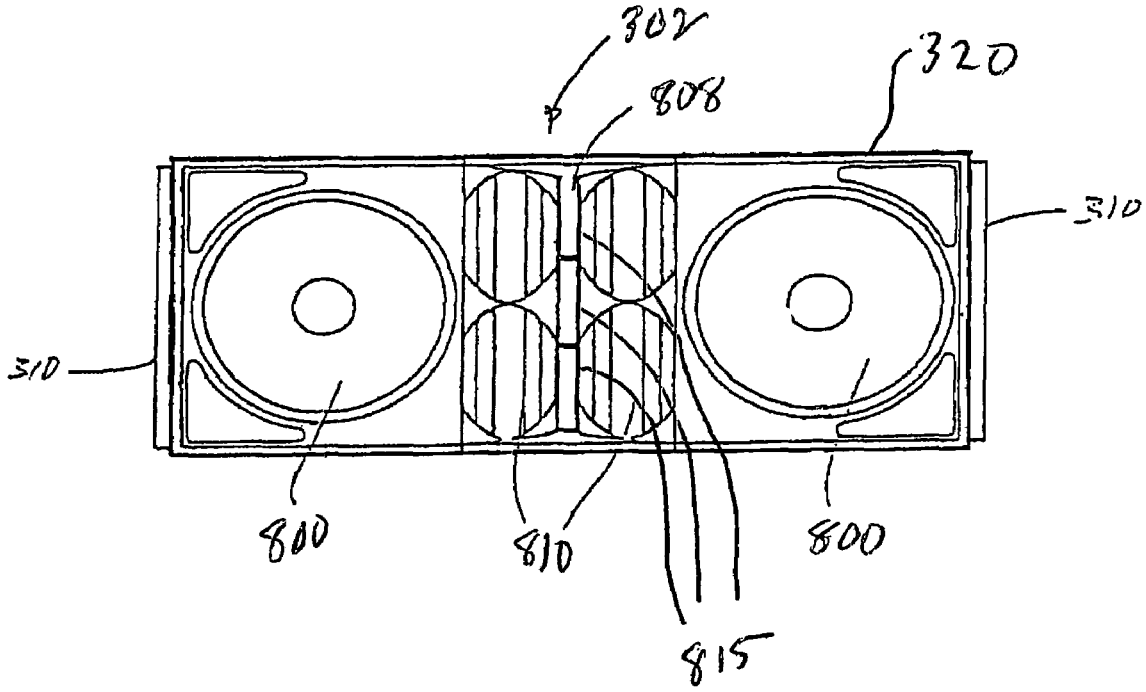
FIG. 8 is a front view of a line array speaker.

FIG. 8 is a front view of a line array speaker 302. The speaker 302 integrates the unique acoustical elements into a highly portable and rugged physical package. In one embodiment, the speaker 302 may weigh less than 72 kg while containing two 600-watt low frequency drivers 800, each having a diameter of about 15 inches. Four 300-watt mid-frequency drivers 810, each having a diameter of about 8 inches may also be included, as well as three vertically stacked 75-watt, 3-inch diaphragm high frequency compression drivers 815 each exiting through a throat opening 808 having a width of about ¾" to about 1¼". Each (low/mid/high) frequency driver section may be positioned on the enclosure to align with identical sections of adjacent housings 320 with minimum separation between adjacent housing driver sections so as to form a continuous 'line' of like driver components.

Figure 9:
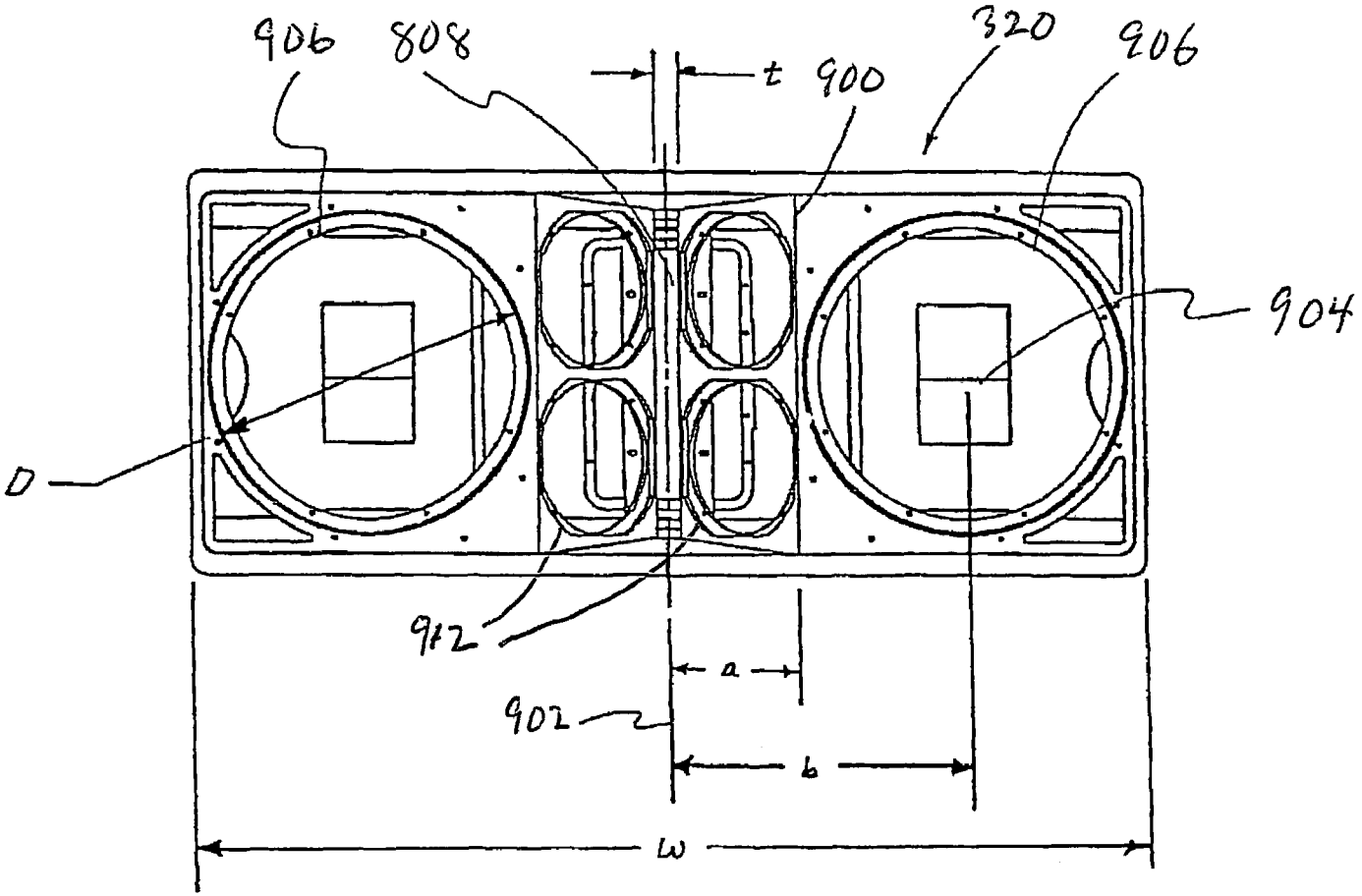
FIG. 9 is a front view of the line array speaker housing.

In FIGS. 8-11, the nine speakers (two 15-inch low frequency drivers 800, four 8-inch mid-frequency drivers 810, and three high frequency drivers 815) are incorporated into a speaker housing 320 that has a width "w" that is less than about 46 inches. FIG. 9 is a front view of the speaker housing 320 having the front cover removed to show an example of how the nine speakers 800, 810 and 815 would be positioned in the housing 320. As seen in FIGS. 8 and 9, the speaker housing 320 has a throat opening 808 adapted to receive three high-frequency speakers 815 stacked vertically in the center of the housing 320. The speaker housing 320 also has openings 912 to receive two mid-range speakers 810 stacked vertically on each side of the high-frequency speakers 815, for a total of four mid-range speakers 810. In addition, one low range speaker 800 can be positioned on the outside of each of the vertically stacked mid-range speakers 810 in a corresponding opening 906 of the housing 320, for a total of two low-range speakers 800.

Figure 10:
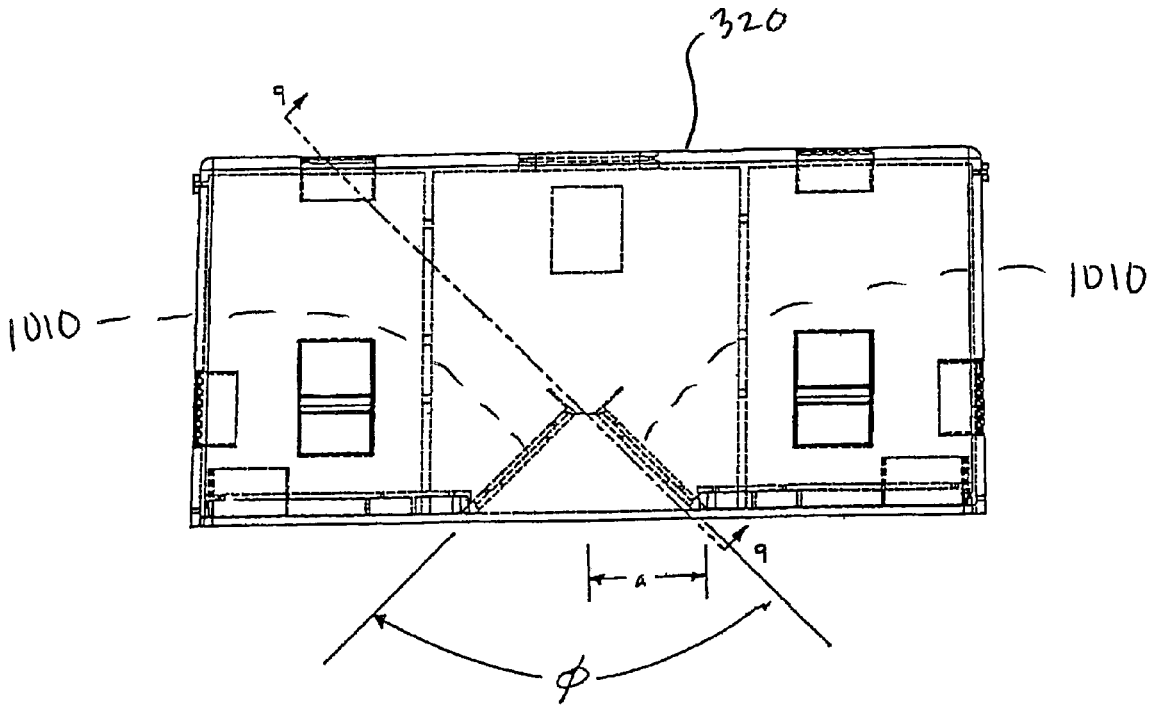
FIG. 10 is a top view of the speaker housing.

To configure the speakers 302 in this manner, the speaker housing 320 has a transition line 900 formed at about distance "a" from a centerline 902 as shown in FIG. 9, and the mid-range speakers 810 are positioned in side walls 1010 that are angled adjacent to one another as shown in FIGS. 9 and 10. FIG. 10 is a top view of the speaker housing 320 of FIG. 9 and illustrates the angle Φ between the adjacent sidewalls 1010. In the example given in FIGS. 8-11, if the angle Φ between two adjacent side walls 1010 incorporating the mid-range drivers 810 is about 90° (see FIG. 10), then the distance ("a") between the center line 902 and the transition line 900 may be about 6.21 inches (see FIG. 9). Moreover, referring to FIG. 9, the distance ("b") between the centerline 902 and the focal point 904 for the opening 906 adapted to receive the low frequency driver 800 may be about 14.29 inches. The opening 906 may have an outer diameter ("D") of about 15.34 inches to receive a 15-inch low frequency driver 800. For this example, the width ("t") of the throat opening 808 may be about 1.13 inches.

Figure 11:
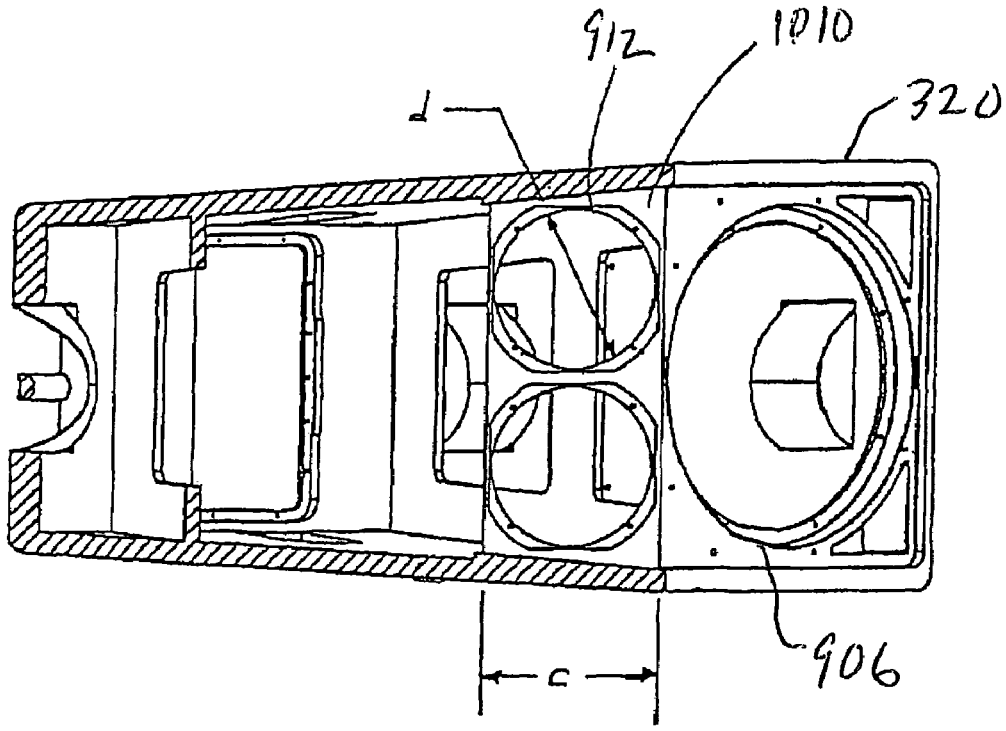
FIG. 11 is a cross-sectional view of the speaker housing taken along line a-a of FIG. 10.

In FIG. 11, which is a cross-sectional view of the speaker housing 320 taken along line a-a of FIG. 10, if the angle Φ in FIG. 10 is about 90°, then the width ("c") of the side wall 1010 adapted to receive the two mid-range frequency drivers 810 (FIG. 8) may be about 7.98 inches, and the inner diameter ("d") for the opening 912 adapted to receive an 8-inch mid-range driver 810 may be about 7.25 inches. With the above exemplary dimensions, the width ("w") for the speaker housing 320 may be about 45.75 inches (see FIG. 9). With the width of the rigging frames 310 (see FIG. 8) being about 1.0 inch on each side, the total width of the array speaker 302 (see FIG. 8) is less than about 48.0 inches. Depending on the angle Φ between the two adjacent side walls 1010, however, the total width "w" may be less than 45.75, if the angle Φ is less than 90°.

Figure 12:
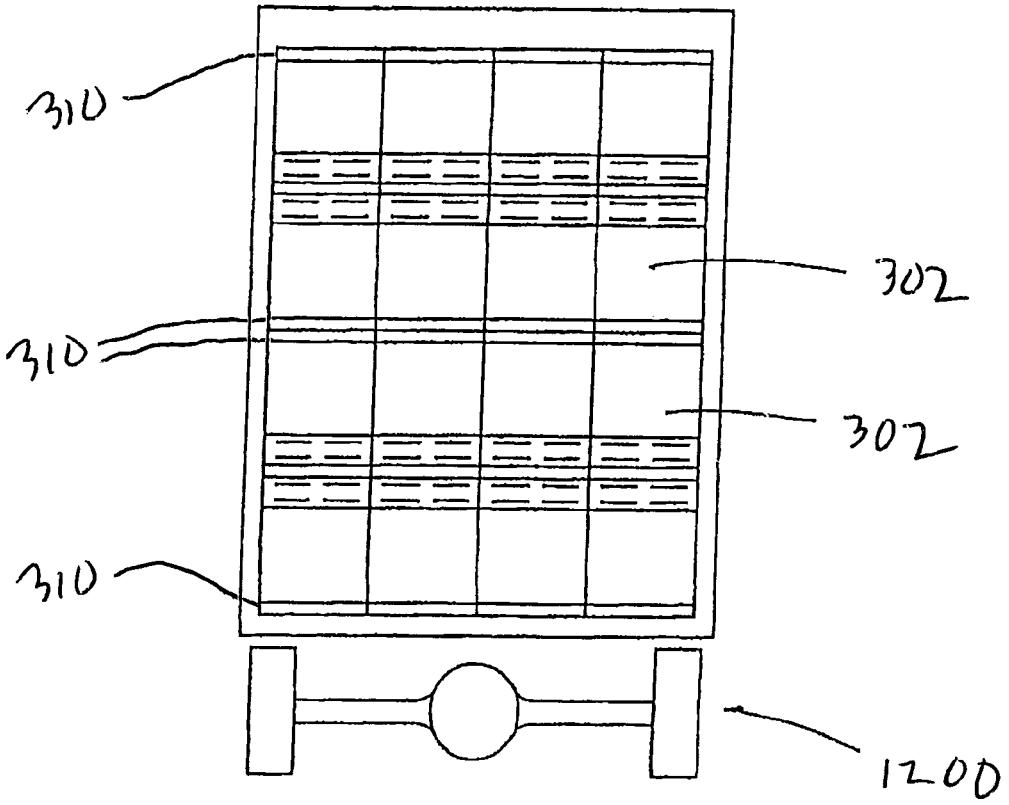
FIG. 12 is a rear view of a typical transportation truck system loaded with the line array systems.

FIG. 12 is a rear sectional view of a typical transportation truck 1200 loaded with line array speakers 302 coupled with rigging frames 310 on the right and left sides of the speakers 302. As previously discussed, it may be desirable to vertically double stack the line array speakers 302 (speaker 302 plus rigging frames 310 coupled) in an industry standard transport type truck 1200 having about a 96-inch vertical cargo height. As illustrated in FIG. 12, with each line array speaker 302 having a width of less than about 48 inches, it is possible to double stack the line array speakers 302 in a truck 1200 having about a 96-inch vertical cargo height, thereby reducing the number of transportation trucks 1200 needed to ship the line array speakers 302.

Figure 13:
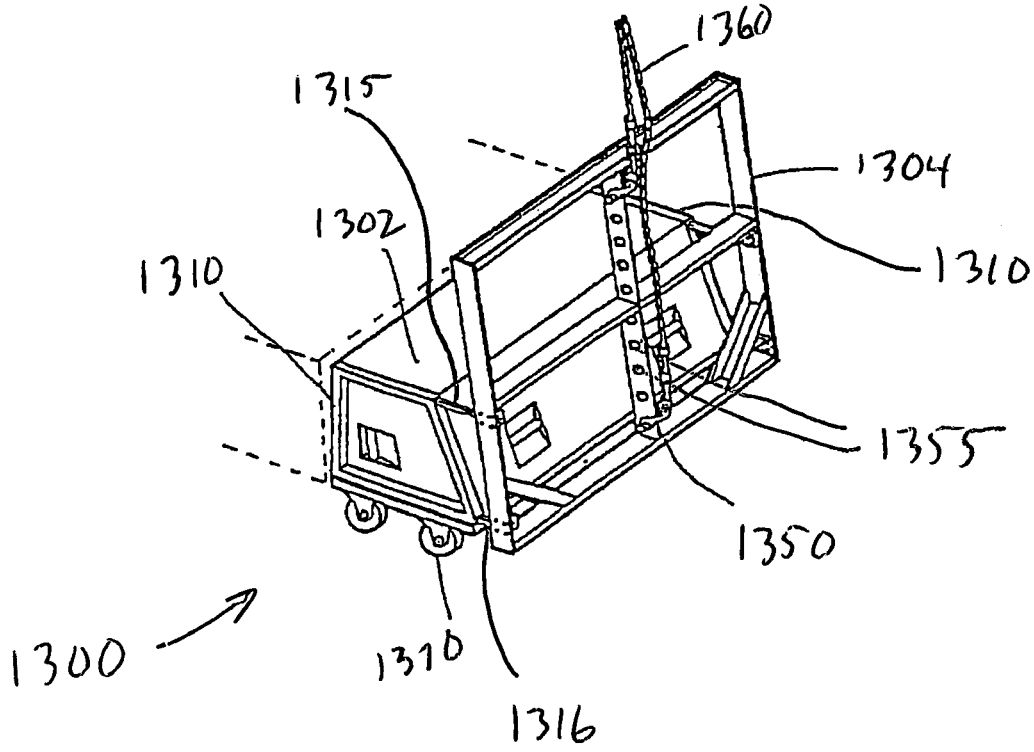
FIG. 13 is a perspective view of an end speaker in a line array speaker assembly having an array frame attached to the rigging frame of the speaker.
Figure 14:
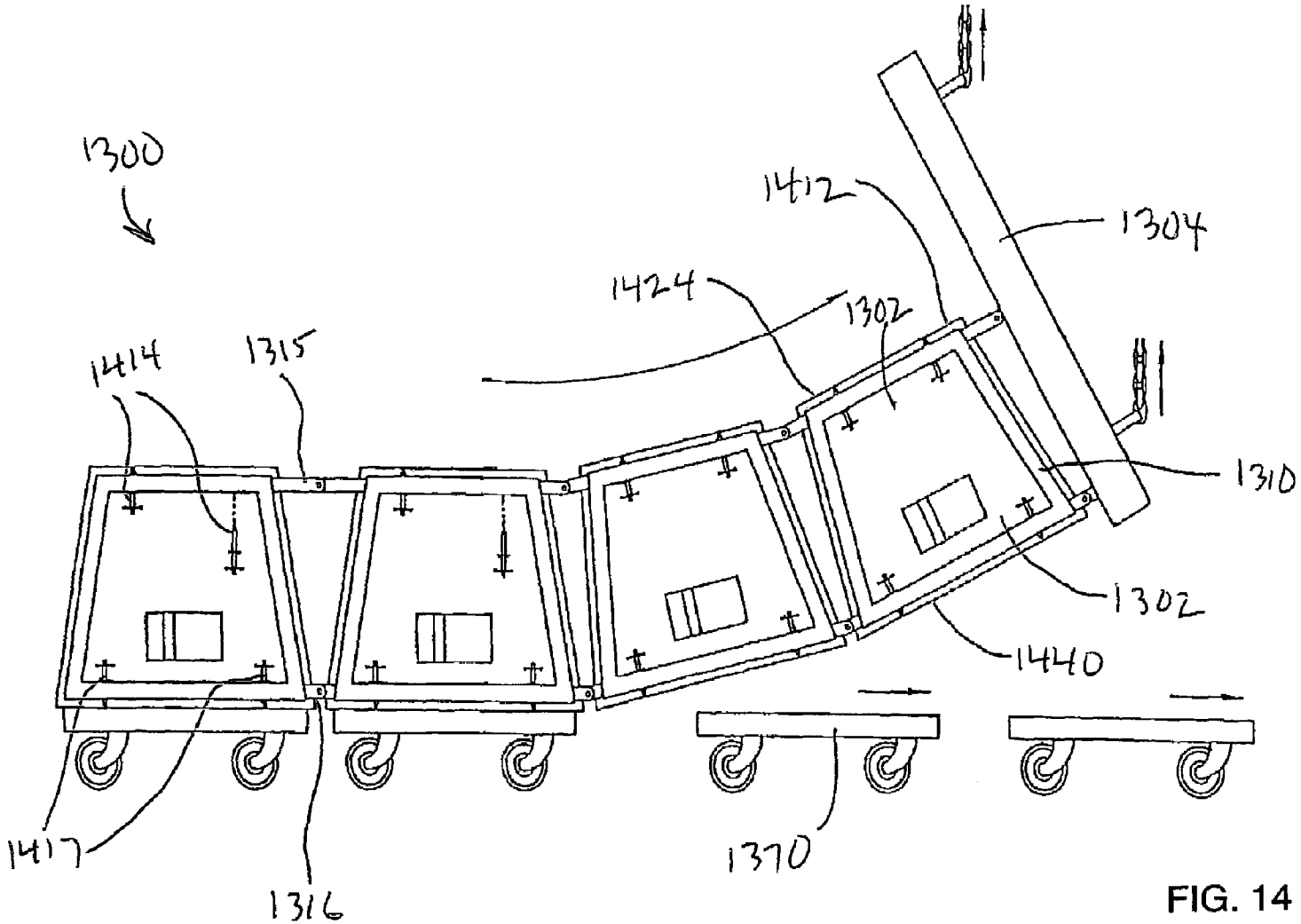
FIG. 14 is a perspective view of the line array system being assembled and lifted.

FIGS. 13 through 14 illustrate, by way of example, how the line array speakers 1302 with the rigging frames 1310 are moved and assembled together to be suspended in the air. FIG. 13 is a perspective view of an end speaker 1302 in a line array speaker assembly 1300 having an array frame 1304 attached to the rigging frames 1310 of the speaker 1302. As seen in FIG. 13, each line array speaker 1302 is provided with left and right rigging frames 1310 and may further have a dolly with wheels 1370 removably attached to the bottom of each speaker 1302 in the assembly 1300. Additionally, an array frame 1304 is positioned at a desired location, typically one at each end of the line array assembly 1300, and may be attached to the rigging frame 1310 through the use of the rear hinge 1315 and front hinge 1316, or in another similar manner. The array frame 1304 includes front and rear receiver blocks (not shown) for coupling the hinges 1315 and 1316 to the array frame 1304. The array frame 1304 may be made of 6061 T-6 aluminum or other like material, and may include a plurality of holes (not shown) for fitting shackles 1350 in order to suspend the line array 1300 in the air.

A typical line array 1300 may have only one array frame 1304. However, a second array frame 1304 may be utilized to couple to both the top (or first) and the bottom (or the last) line array speaker 1302 and suspend the line array 1300 from both array frames 1304. This may create an increased directivity of the line array 1300. Using one or two array frames 1304, the line arrays 1300 may be manipulated to suspend pointing straight down or suspend at a very wide vertical angle.

To suspend a line array 1300, one or more shackles 1350 are pinned in selected holes 1355 in the array frame 1304. The shackles 1350 are then attached to suspension cables 1360 and one or more chain motors (not shown) are used to ultimately raise the array frame 1304. If only one chain motor is used, one should select a hole 1355 in the array frame 1304 that allows the array frame 1304 to be balanced, taking into account the center of gravity of the line array system 1300. This varies with the number of speakers 1302 in the line array 1300 and system configuration. A typical hanging suspension uses two chain motors.

The top or the first line array speaker 1302 is attached to the array frame 1304. When the array frame 1304 is to be suspended, one way to assemble the line array 1300 would be to first suspend the array frame 1304, then attach the first (top) speaker 1302 by rolling the speaker 1302 up to the array frame 1304. The attachment is accomplished by connecting the rear hinge bars 1315 to the rear receiver blocks (not shown) on the array frame 1304. Using this method, the rear hinge bars 1315 may be connected first. The first speaker 1302 should be set so that its baffle angle is 90 degrees in relationship to the array frame 1304. This puts the first speaker 1302 in a zero-degree position. Next, the front hinge bars 1316 on the first speaker 1302 are attached to the front receiver blocks (not shown) of the array frame 1304.

As illustrated by FIG. 14, which is a perspective view of the line array system 1300 being assembled and lifted, the line array frame 1304 may be lifted using the chain motor prepared to lift the first speaker 1302 off the floor. The additional speakers 1302 may now be moved into line and the front hinge bars 1316 may be linked first. While pulling the array 1304 up slightly, the rear hinge bars 1315 on the additional speakers 1302 may be pinned at a predetermined distance or splay angle by sliding the releasing pin 1414 into the desired angle bores on the rear hinge bar 1315 and the matching hole on the rear side 1412 of the rigging frame 1300.

With the above method, additional line array speakers 1302 may be added as the array frame 1304 moves up by repeating the process of first pinning the front hinge bars 1316 and then the rear hinge bars 1315. As the array frame 1304 is lifted slightly, all the fittings should be checked to ensure that the release pins 1414 are in place and secure, the hinge bars 1315 and 1316 are set at the desired angle and the hinge bars 1315 and 1316 are set the same on both sides of each line array speaker 1302. Also, as illustrated in FIG. 14, as the array frame 1304 begins to go up, the dollies 1370 on the line array speaker 1302 may be removed. The dolly 1370 is typically equipped with a quick release latch and side handles (not shown).

There are many other ways to assemble the line array speakers 1302. For example, the rear hinge bars 1315 may be coupled first between the adjacent speakers 1302 before connecting the front hinge bars 1316. With each line array speaker unit 1302 equipped with a dolly 1370 and rigging frames 1310 capable of being connected to each other by simply sliding and inserting a releasing pin 1414, unloading the entire assembly and suspending a line array system 1300 of up to eighteen speakers 1302 can be accomplished in less time, using less personnel, than it would take to assemble a conventional line array assembly of the same size.

Additionally, the rigging frame assembly may be designed in other configurations that would allow the splay angle between two adjacent speakers 1302 to be adjusted. Any mechanism that will allow for the front surfaces 1440 of two adjacent speakers 1302 to be pivotally connected, while allowing the splay angle between the back sides 1424 of the two adjacent speakers 1302 to be coupled such that the angle between the speakers 1302 can be easily adjusted is within the scope of this invention.

Figure 15:
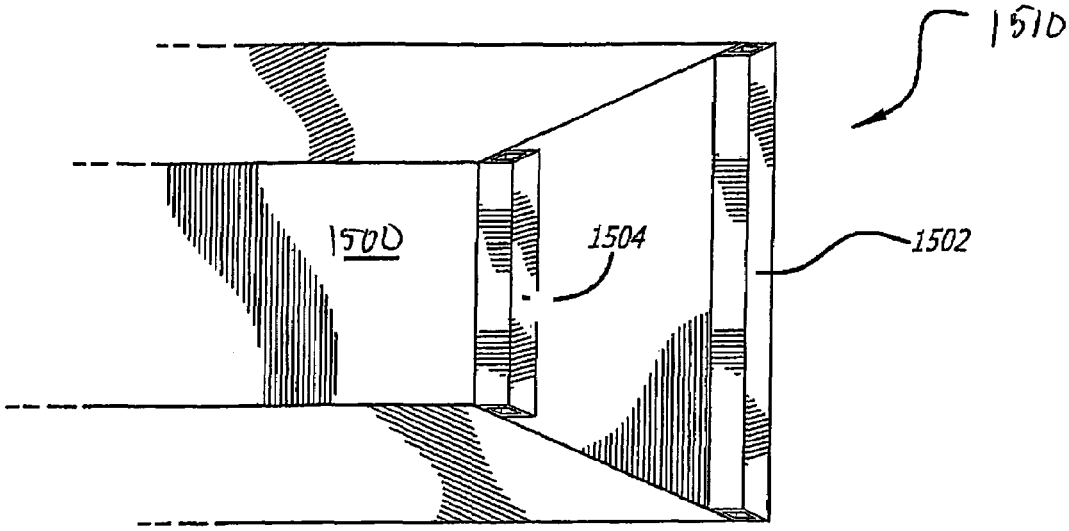
FIG. 15 is a rear perspective view of a line array speaker coupled to an alternative rigging frame on one side of the speaker.

For example, FIG. 15 is a rear perspective view of a line array speaker 1500 coupled to an alternative rigging frame 1510 on one side of the speaker 1500. Although the rigging frame 1510 can only be seen fully on one side of the line array speaker 1500 in FIG. 15, the rigging frames 1510 are positioned on both the left and right sides of the line array speaker 1500. The rigging frame 1510 includes a front side 1502 and a rear side 1504 that are coupled to the side of the line array speaker 1500. The front and rear sides 1502 and 1504 may be substantially similar to the front and rear sides 311 and 312 described above in conjunction with FIG. 3, respectively, but without the lateral members 342 and 344 as shown in FIG. 3.

Figure 16:
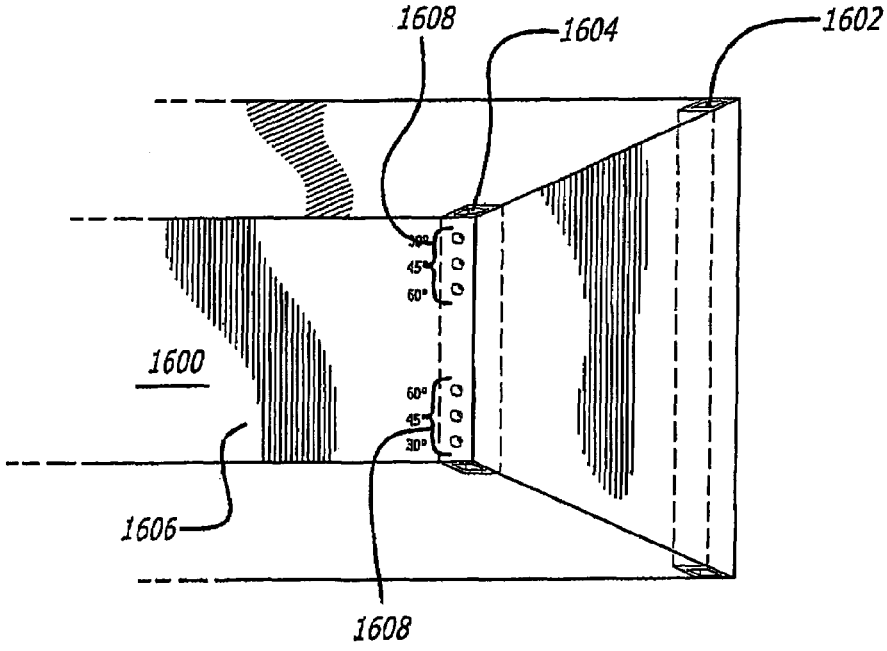
FIG. 16 is a rear perspective view of one side of a line array speaker having a front opening and a rear opening integrated into the speaker housing.

FIG. 16 is a rear perspective view of one side of a line array speaker 1600 having a front opening 1602 and a rear opening 1604 integrated into the speaker housing. The front and rear openings 1602 and 1604 are similar to the openings 425 and 430 formed on the front and rear sides 411 and 412, respectively, as the rigging frame 410 illustrated in FIG. 4. As such, the front and rear openings 1602 and 1604 are adapted to receive the front and rear hinge bars 416 and 415, respectively (see FIG. 4). The back side 1606 of the line array speaker 1600 has a plurality of openings 1608, where each opening 1608 is marked with a specific numeric angle similar to the plurality of openings 413 formed on the rear side 412 of the rigging frame 410 as discussed above (see FIG. 4). The front side of the line array speaker 1600 may have an opening so that a release pin (not shown) may be inserted through the opening on the front side of the speaker 1600 to engage with the front hinge bar 416.

Figure 17:
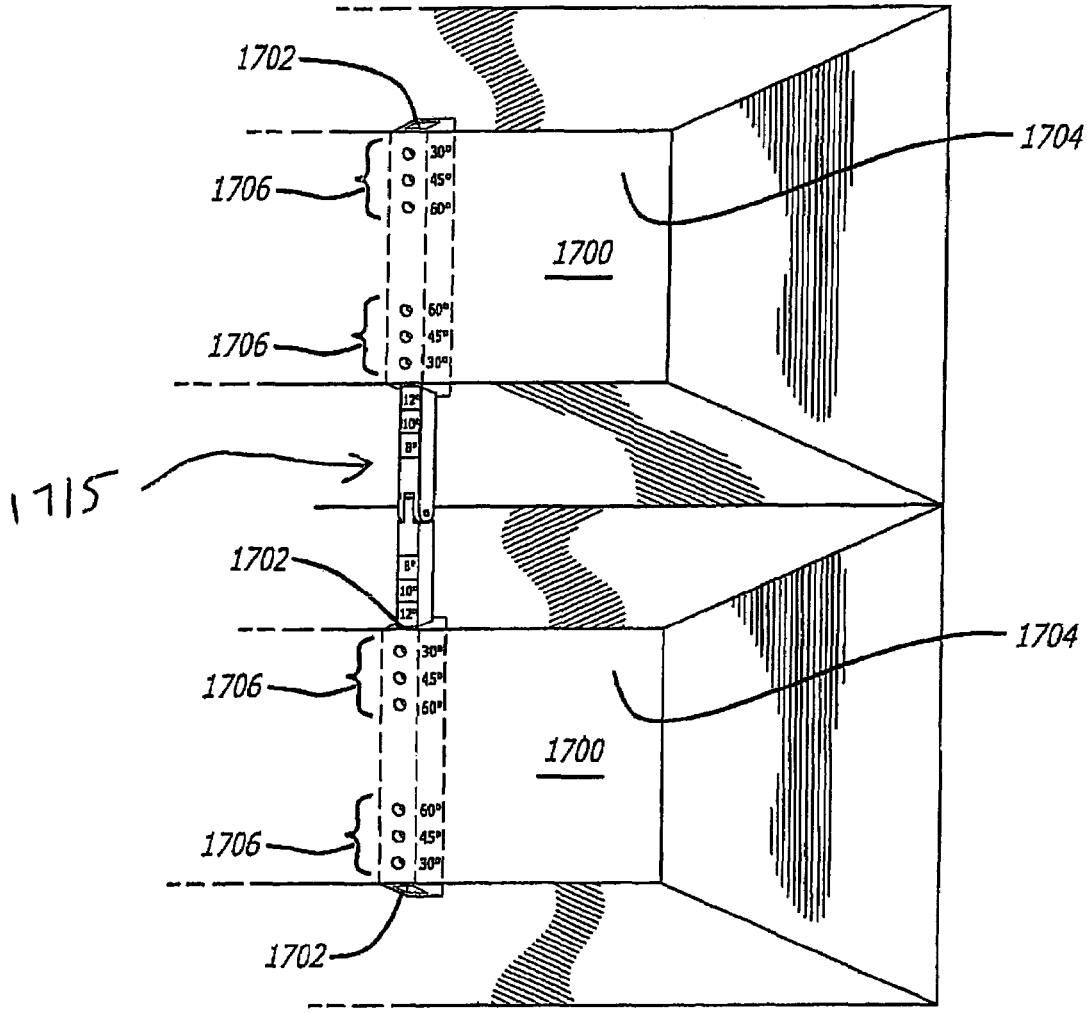
FIG. 17 is a rear perspective view of two adjacent line array speakers that are adapted to couple to each other.
Figure 1:
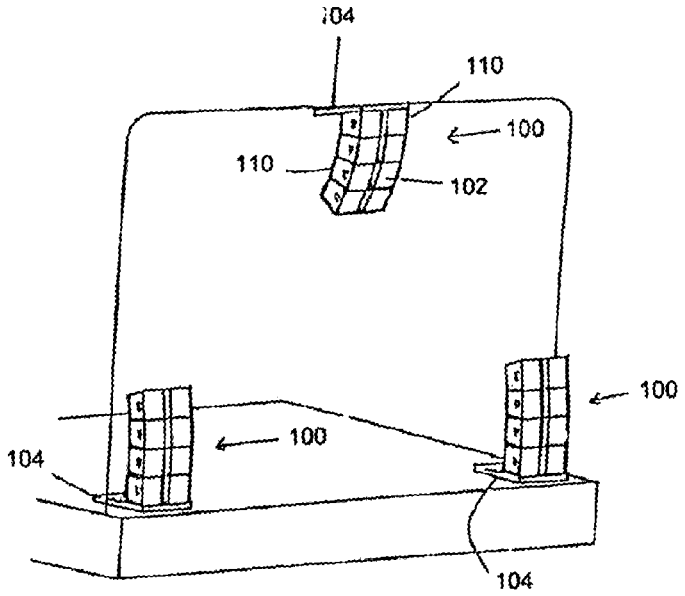
Figure 2:
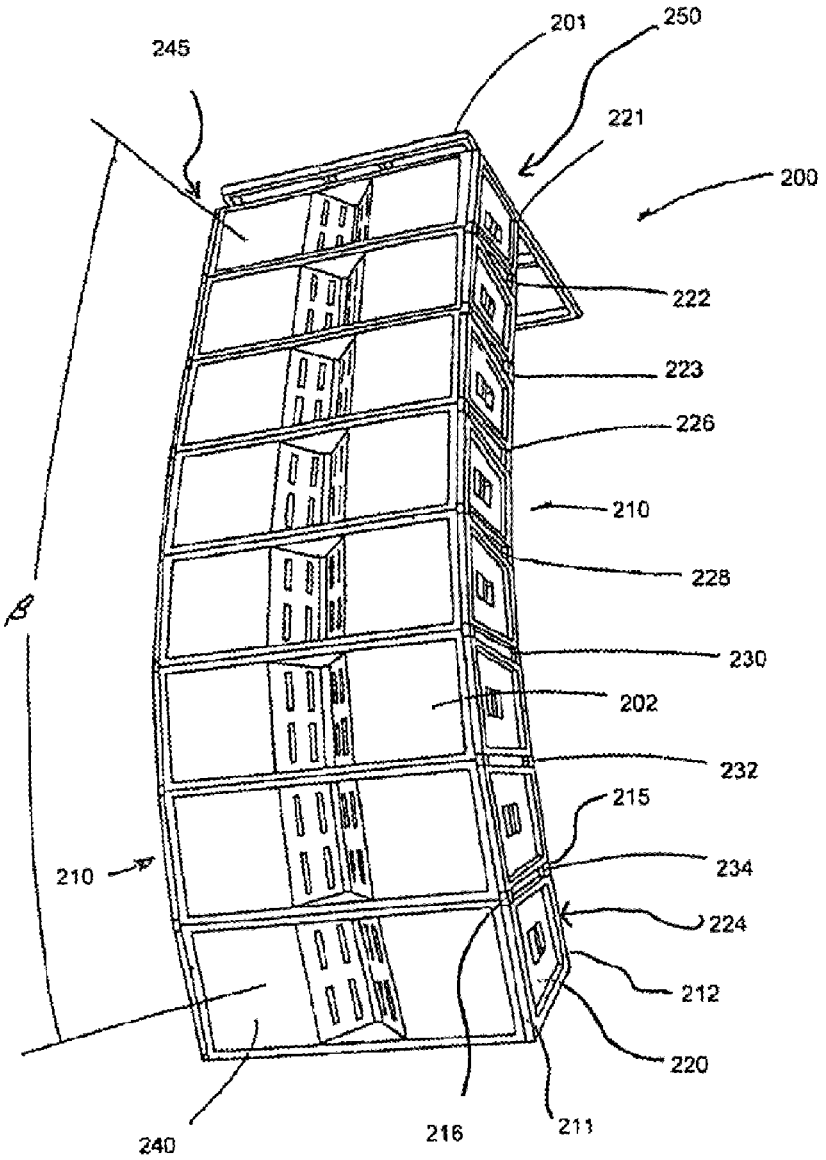
Figure 3:
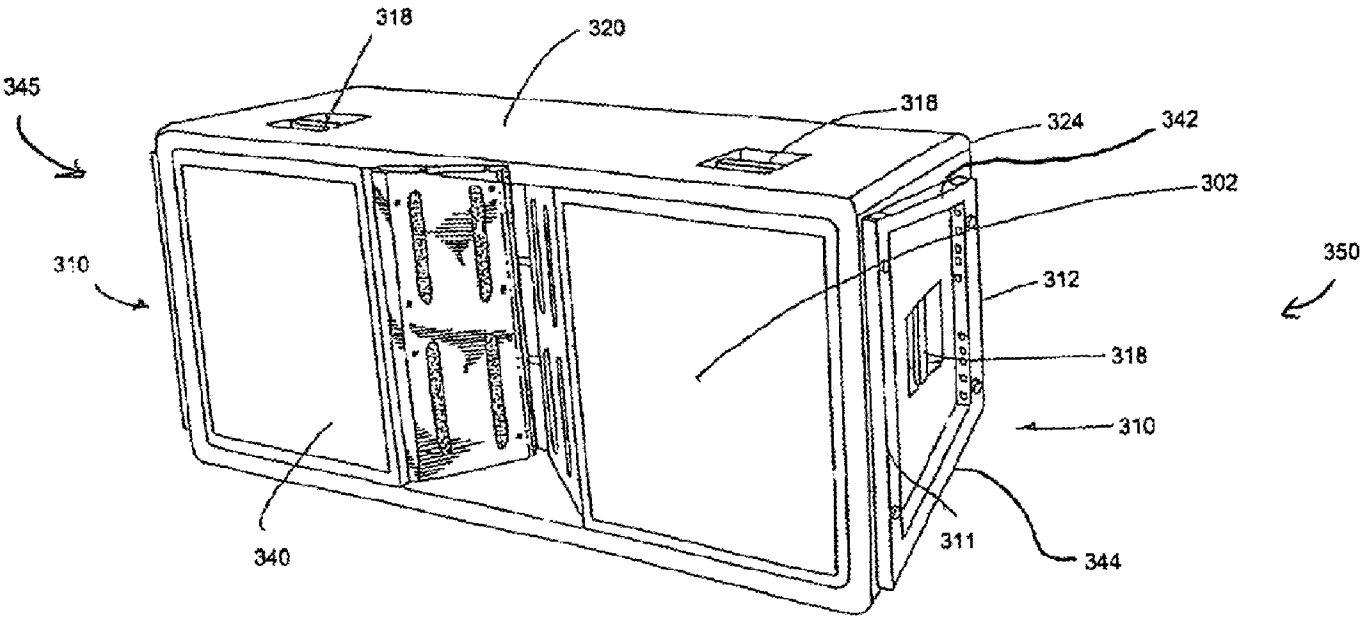
Figure 4:
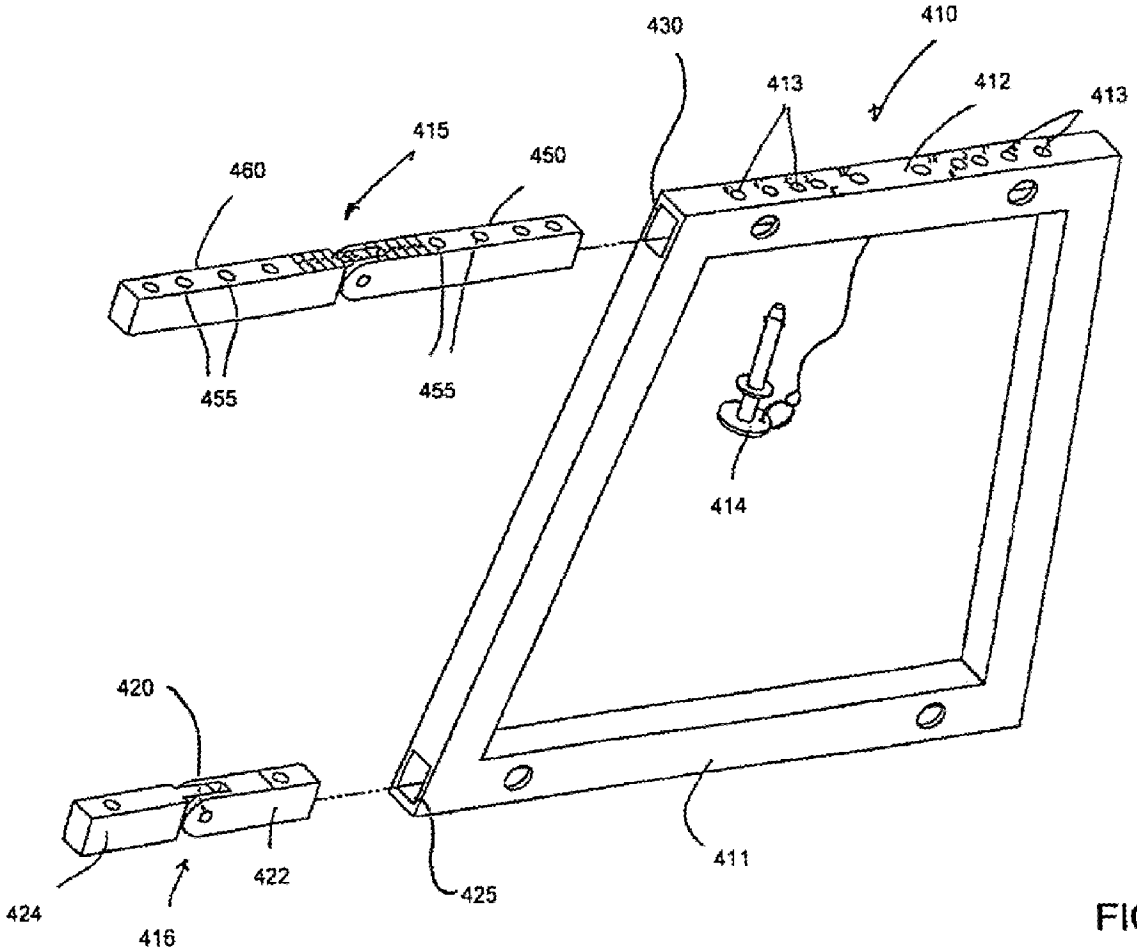
Figure 5:
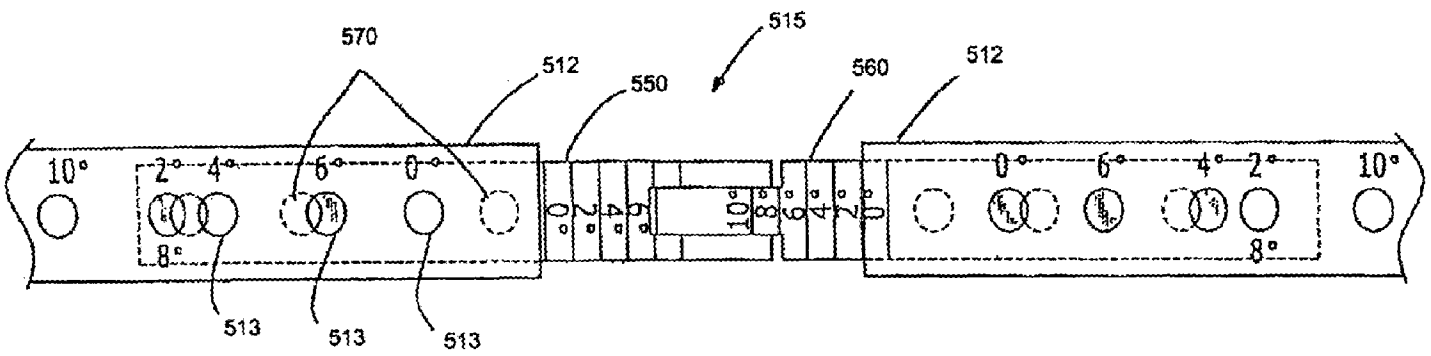
Figure 6:
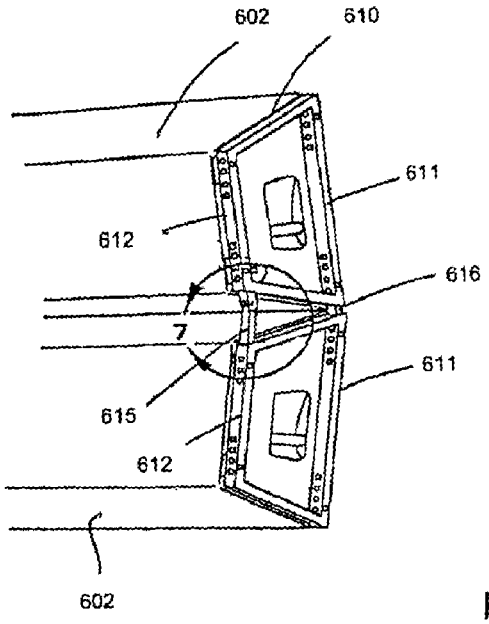
Figure 7:
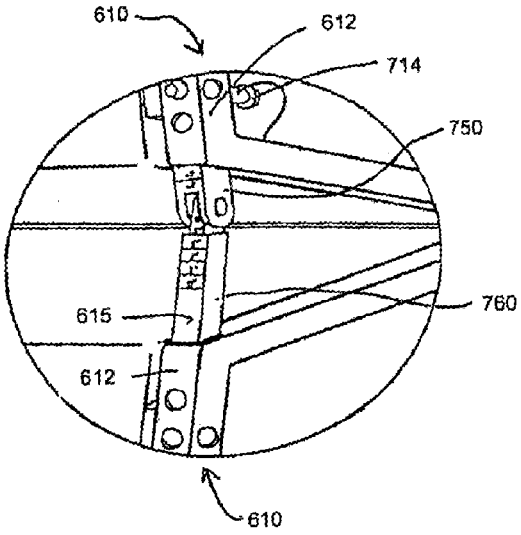
Figure 8:
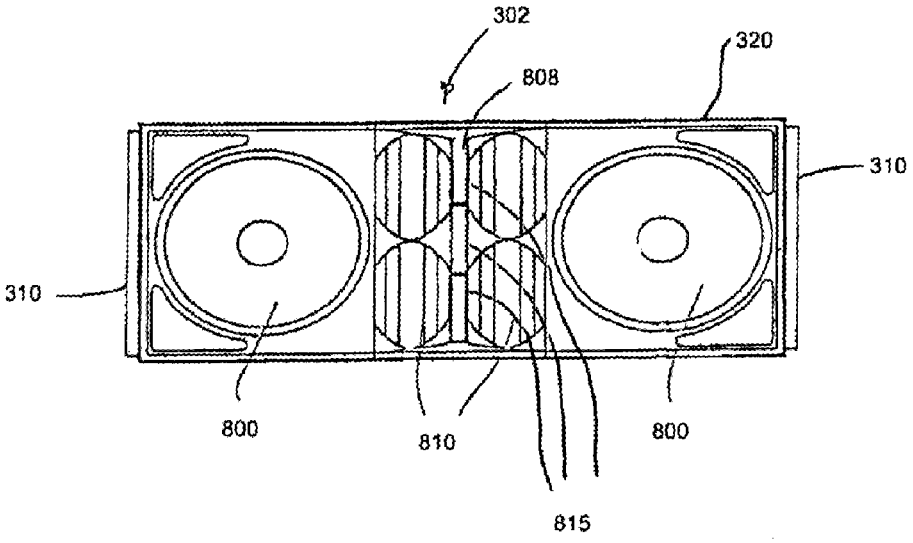
Figure 9:
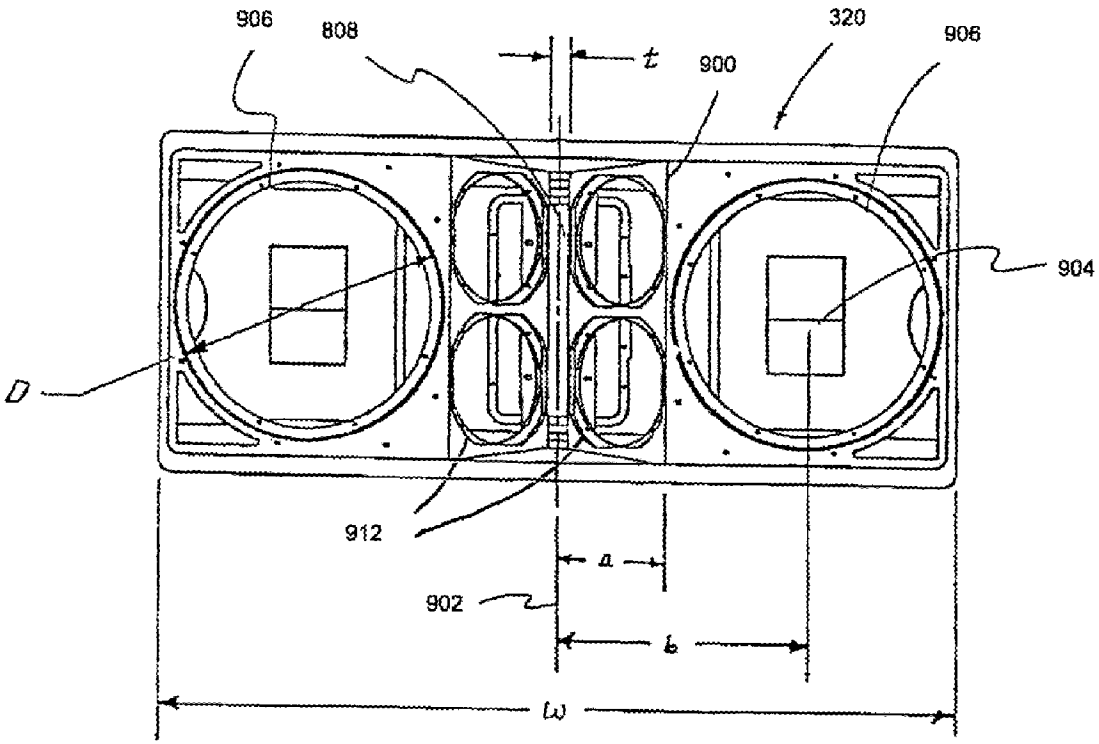
Figure 10:
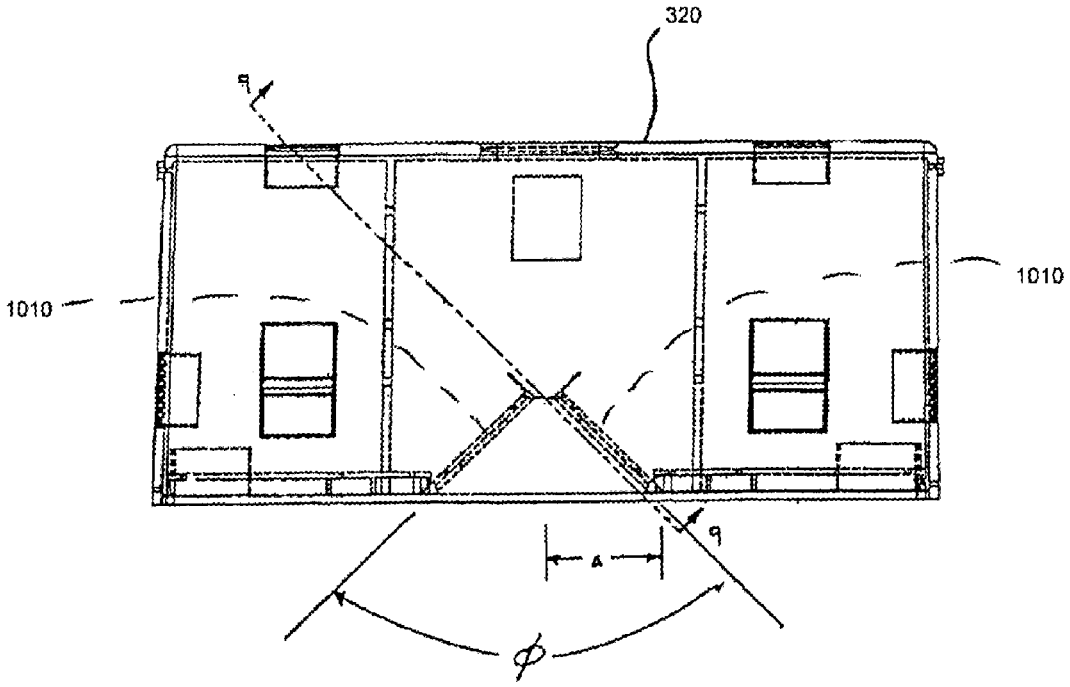
Figure 11:
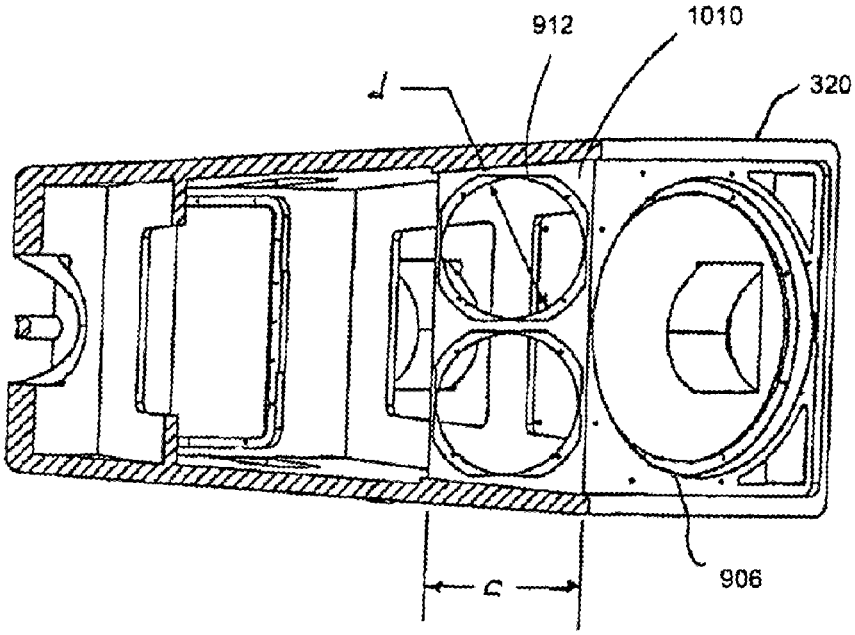
Figure 12:
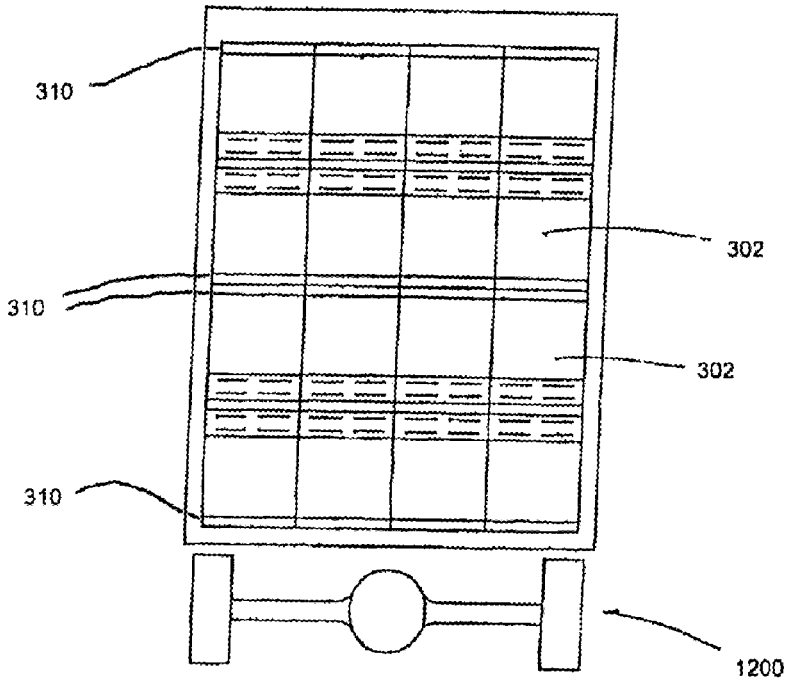
Figure 13:
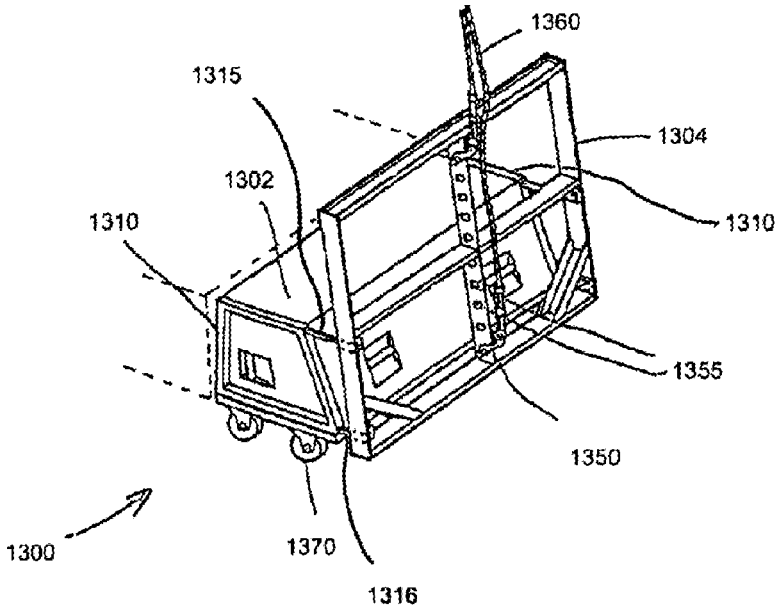
Figure 14:
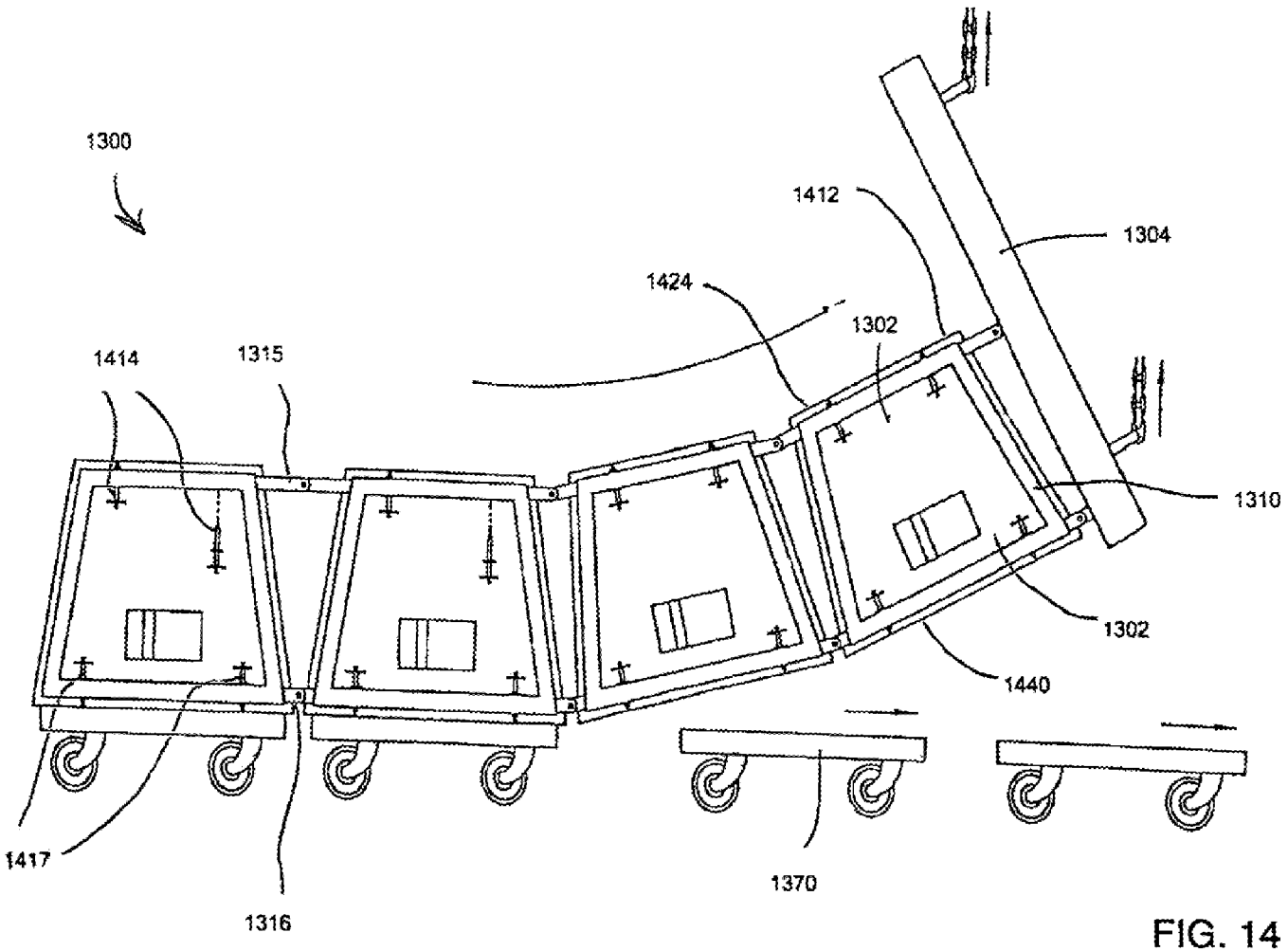
Figure 15:
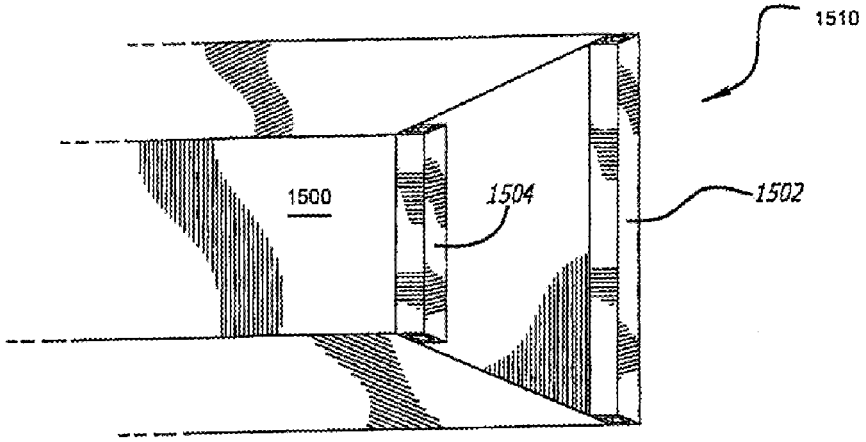
Figure 16:
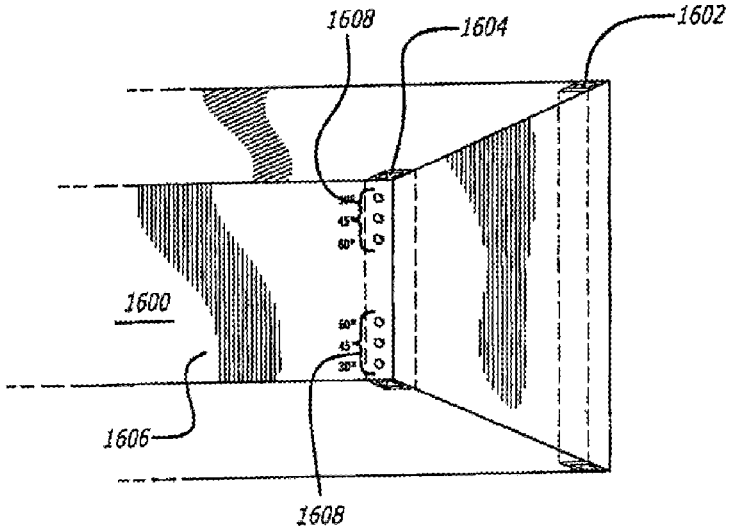
Figure 17:
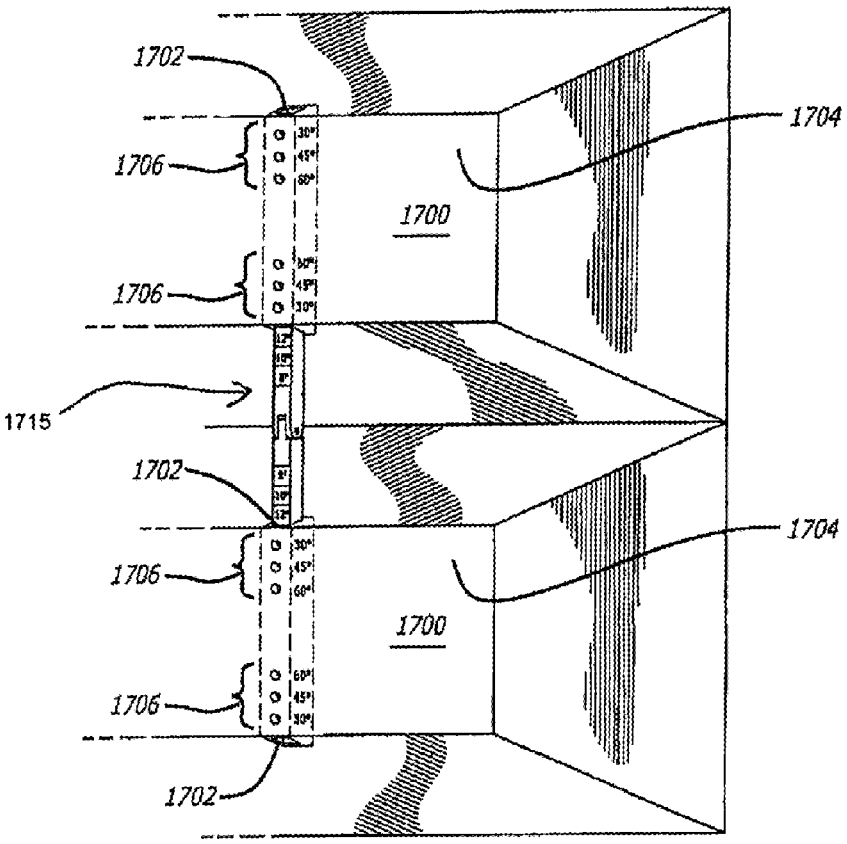

FIG. 17 is a rear perspective view of two adjacent line array speakers 1700 that are adapted to couple to each other. Each line array speaker 1700 may have an opening 1702 on the back side 1704. The opening 1702 may be formed substantially along the center or anywhere in between the left and right sides of the speaker 1700. The opening 1702 is similar to the opening 430 formed on the rear side 412 of the rigging frame 410 illustrated in FIG. 4. The back side 1704 of the speaker 1700 has a plurality of openings 1706 so that a release pin 414 (FIG. 4) may be inserted through one of the openings 1706 to engage with the rear hinge bar 1715. Each opening 1706 is marked with a specific numeric angle similar to the plurality of openings 413 formed on the rear side 412 of the rigging frame 410 illustrated in FIG. 4, so that the splay angle between the two adjacent line array speakers 1700 may be adjusted as discussed above. The front sides of the two adjacent line array speakers 1700 may be pivotally coupled to each other as discussed above or any other method known to one skilled in the art.

While various embodiments of the application have been described, it will be apparent to those of ordinary skill in the art that many more embodiments and implementations are possible within the scope of this invention. Accordingly, the invention is not to be restricted except in light of the attached claims and their equivalents.

What is claimed is:

1. A line array speaker assembly, comprising:

a plurality of speakers aligned adjacent to one another, each speaker having a rigging frame attached to at least one side of the speaker, each rigging frame including a front side and a rear side;

a plurality of front hinges slidably coupled between the corresponding front sides of the rigging frames of the adjacent speakers in the line array assembly; and a plurality of rear hinges slidably coupled between the corresponding rear sides of the rigging frames of the adjacent speakers in the line array assembly.

2. The line array speaker assembly of claim 1, where the rear hinges may be coupled to the corresponding rear sides of the rigging frames of the adjacent speakers at various coupling points along the rear hinges to allow for the angle between the adjacent speakers to be adjusted.

3. The line array speaker assembly of claim 2, where the various coupling points along the rear hinges are marked to indicate the resulting angle between the speakers when the rear hinges are coupled to the corresponding rear sides of the rigging frames of the adjacent speakers at the various coupling points.

4. The line array speaker assembly of claim 3, where the rear hinge coupling points are marked in two degree increments.

5. The line array speaker assembly of claim 2, where the various coupling points along the rear hinges have holes extending through the rear hinges that can be removably coupled with corresponding holes in the rear sides of the rigging frames of the adjacent speakers.

6. The line array speaker assembly of claim 1, where the respective rear sides of the rigging frames of the adjacent speakers have various coupling points that are marked to indicate the resulting angle between the speakers should the rear hinges be coupled to the respective rear sides of the rigging frames of the adjacent speakers at the various coupling points.

7. The line array speaker assembly of claim 6, where the coupling points on the rear side of each rigging frame are marked in two degree increments.

8. The line array speaker assembly of claim 6, where the various coupling points along the respective rear sides of the rigging frames of the adjacent speakers have holes extending through the respective rear sides of the rigging frames that can be removably coupled to corresponding holes in the corresponding rear hinges.

9. The line array speaker assembly of claim 1, where each front hinge has a first arm and a second arm coupled at a pivot point and where the respective front sides of the rigging frames of the adjacent speakers are adapted to releasably couple to the corresponding arms of the respective front hinges.

10. The line array speaker assembly of claim 1, where at least one of the rigging frames is further adapted to couple to an array frame for suspending the line array speaker assembly in the air or positioning the line array speaker assembly on the ground.

11. The line array speaker assembly of claim 1, where each speaker has a dolly removably attached to the speaker for ease in transportation.

12. The line array speaker assembly of claim 1, where each speaker is less than 48 inches in width.

13. A loudspeaker connection system, comprising:

a pair of first rigging frames each having a front side and a rear side, where the pair of first rigging frames are adapted to incorporate a first speaker between the pair of first rigging frames, and the pair of first rigging frames are adapted to pivotally couple to an adjacent pair of second rigging frames along the respective front sides of the pair of first rigging frames; and a pair of rear hinges adapted to couple the pair of first rigging frames to the adjacent pair of corresponding second rigging frames at a predetermined distance along the respective rear sides of the pair of first rigging frames to form a desired curvature along the front sides of the pair of first rigging frames and corresponding front sides of the adjacent pair of second rigging frames.

14. The loudspeaker connection system according to claim 13, further including a pair of front hinges adapted to slidably insert within the respective front sides of the pair of first rigging frames and the corresponding front sides of the adjacent pair of second rigging frames to pivotally couple the respective front sides of the pair of first rigging frames and the corresponding front sides of the adjacent pair of second rigging frames.

15. The loudspeaker connection system according to claim 13, where in each rigging frame the front side is longer than the rear side.

16. The loudspeaker connection system according to claim 13, where the speaker is a line array speaker.

17. The loudspeaker connection system according to claim 13, where the adjacent pair of second rigging frames is adapted to incorporate a second speaker.

18. The loudspeaker connection system according to claim 13, where the predetermined distance between the pair of first rigging frames and the adjacent pair of second rigging frames determines a line array splay angle.

19. The loudspeaker connection system according to claim 13, where the speaker includes:

four mid-range frequency drivers between two low-range frequency drivers, where the four mid-range drivers are flushed into two adjacent side walls, where two of the four mid-range frequency drivers are on each side wall and the two adjacent side walls form a predetermined angle with respect to each other; and a throat opening between the two adjacent side walls at a vertex of the two adjacent walls, where the throat opening is adapted to couple to three high frequency drivers.

20. The loudspeaker connection system according to claim 19, where the predetermined angle is about 90°.

21. The loudspeaker connection system according to claim 19, where the total width between the pair of first rigging frames is less than about 48 inches.

22. The loudspeaker connection system according to claim 13, where each first rigging frame has a trapezoidal shape.

23. The loudspeaker connection system according to claim 13, further including an array frame adapted to couple to the pair of first rigging frames, where the array frame is used to raise the loudspeaker connection system.

24. The loudspeaker connection system according to claim 13, further including a release pin adapted to releasably lock each of the pair of rear hinges to the corresponding rear sides of the pair of first rigging frames.

25. The loudspeaker connection system according to claim 13, where the pair of first rigging frames are made of steel.

26. The loudspeaker connection system according to claim 13, where each rear side has a predetermined number of openings, and each rear hinge has a predetermined number of bores, where at least one of the bores corresponds to at least one of the openings to provide the predetermined distance along the respective rear sides of the pair of first rigging frames.

27. The loudspeaker connection system according to claim 26, where each of the bores and the openings are marked to indicate a splay angle when a matching bore and opening are pinned together.

28. A method for arranging speakers, comprising:

providing at least two adjacent speakers, each speaker including at least one rigging frame, each rigging frame including a front side and a back side;

pivotally coupling the respective front sides of the rigging frames of the at least two adjacent speakers together with at least one front hinge bar; and coupling the respective rear sides of the rigging frames of the at least two adjacent speakers at a predetermined distance to form a desired curvature along a front of the at least two adjacent speakers.

29. The method according to claim 28, further including:

adjusting the predetermined distance.

30. The method according to claim 28, further including:

coupling an array frame to at least one of the adjacent speakers;

coupling a shackle to the array frame;

coupling a suspension cable to the shackle; and raising the array frame using a chain motor.

31. The method according to claim 28, the at least two adjacent speakers are substantially flush against each other at the front of the at least two adjacent speakers.

32. The method according to claim 28, where the speakers are line array speakers.

33. A method for suspending a plurality of line array speakers, comprising:

providing a plurality of speakers, where a housing for each speaker is mounted between a pair of rigging frames;

coupling a first speaker of the plurality of speakers to an array frame;

pivotally coupling corresponding pairs of adjacent speakers of the plurality of speakers along the respective front sides of corresponding pairs of rigging frames;

raising the array frame with the first speaker; and adjusting a distance between corresponding pairs of rigging frames of adjacent speakers along the respective rear sides of the rigging frames to form a splay angle between the adjacent speakers.

34. The method according to claim 33, where the speakers are line array speakers.

35. A method for suspending a plurality of line array speakers, comprising:

providing a plurality of speakers, where a housing for each speaker is mounted between a pair of rigging frames;

coupling a first speaker of the plurality of speakers to an array frame;

pivotally coupling corresponding pairs of adjacent speakers of the plurality of speakers along the respective front sides of corresponding pairs of rigging frames;

raising the array frame with the first speaker;

adjusting a distance between corresponding pairs of rigging frames of adjacent speakers along the respective rear sides of the rigging frames to form a splay angle between the adjacent speakers; and inserting a front hinge through the respective front sides of corresponding pairs of rigging frames of adjacent speakers to pivotally couple the corresponding pairs of rigging frames along the respective front sides.

36. A method for suspending a plurality of line array speakers, comprising:

providing a plurality of speakers, where a housing for each speaker is mounted between a pair of rigging frames;

coupling a first speaker of the plurality of speakers to an array frame;

pivotally coupling corresponding pairs of adjacent speakers of the plurality of speakers along the respective front sides of corresponding pairs of rigging frames;

raising the array frame with the first speaker;

adjusting a distance between corresponding pairs of rigging frames of adjacent speakers along the respective rear sides of the rigging frames to form a splay angle between the adjacent speakers; and inserting a rear hinge through the respective rear sides of the corresponding pairs of rigging frames to couple the respective rear sides of the corresponding pairs of rigging frames; and adjusting the distance between the respective rear sides of the corresponding pairs of rigging frames to adjust the splay angle form by the plurality of speakers.

37. A rigging system for suspending a plurality of line array speakers, comprising:

means for providing a plurality of speakers, where a housing for each speaker is mounted between a pair of rigging frames;

means for coupling a first speaker of the plurality of speakers to an array frame;

means for pivotally coupling corresponding pairs of adjacent speakers of the plurality of speakers along the respective front sides of corresponding pairs of rigging frames;

means for raising the array frame with the first speaker; and means for adjusting a distance between corresponding pairs of rigging frames of adjacent speakers along the respective rear sides of the rigging frames to form a splay angle between the adjacent speakers.

38. A rigging system for suspending a plurality of line array speakers, comprising:

means for providing a plurality of speakers, where a housing for each speaker is mounted between a pair of rigging frames;

means for coupling a first speaker of the plurality of speakers to an array frame;

means for pivotally coupling corresponding pairs of adjacent speakers of the plurality of speakers along the respective front sides of corresponding pairs of rigging frames;

means for raising the array frame with the first speaker; and means for adjusting a distance between corresponding pairs of rigging frames of adjacent speakers along the respective rear sides of the rigging frames to form a splay angle between the adjacent speakers;

where the pivotally coupling means includes a plurality of front hinges insertable through the respective front sides of corresponding pairs of adjacent rigging frames of adjacent speakers.

39. A loudspeaker connection system, comprising:

a pair of first rigging frames mounted to a loudspeaker housing, each of the first rigging frame including a first front side and a first rear side;

a pair of second rigging frames mounted to a loudspeaker housing, each of the second rigging frames including a second front side and a second rear side, each second rigging frame being adjacent to a corresponding one of the first rigging frames;

means for adaptively incorporating a first speaker between the pair of first rigging frames;

means for pivotally coupling the pair of first rigging frames to the adjacent pair of second rigging frames along the corresponding first front sides and second front sides; and means for adaptively coupling the pair of first rigging frames to the adjacent pair of second rigging frames at a predetermined distance along the corresponding first rear sides and second rear sides to form a desired curvature along the first front sides of the pair of first rigging frames and the second front sides of the adjacent pair of second rigging frames.

40. The loudspeaker connection system according to claim 39, where in each rigging frame the front side is longer than the rear side.

41. The rigging system according to claim 39, where the first speaker is a line array speaker.

42. A loudspeaker connection system, comprising:

a pair of first rigging frames each including a first front side and a first rear side;

a pair of second rigging frames each including a second front side and a second rear side, each second rigging frame being adjacent to a corresponding one of the first rigging frames;

means for adaptively incorporating a first speaker between the pair of first rigging frames;

means for pivotally coupling the pair of first rigging frames to the adjacent pair of second rigging frames along the corresponding first front sides and second front sides; and means for adaptively coupling the pair of first rigging frames to the adjacent pair of second rigging frames at a predetermined distance along the corresponding first rear sides and second rear sides to form a desired curvature along the first front sides of the pair of first rigging frames and the second front sides of the adjacent pair of second rigging frames;

where the adaptively coupling means includes a pair of rear hinges.

43. A loudspeaker connection system, comprising:

a pair of first rigging frames each including a first front side and a first rear side;

a pair of second rigging frames each including a second front side and a second rear side, each second rigging frame being adjacent to a corresponding one of the first rigging frames;

means for adaptively incorporating a first speaker between the pair of first rigging frames;

means for pivotally coupling the pair of first rigging frames to the adjacent pair of second rigging frames along the corresponding first front sides and second front sides;

means for adaptively coupling the pair of first rigging frames to the adjacent pair of second rigging frames at a predetermined distance along the corresponding first rear sides and second rear sides to form a desired curvature along the first front sides of the pair of first rigging frames and the second front sides of the adjacent pair of second rigging frames; and a pair of front hinges adapted to slidably insert within the first front sides of the pair of first rigging frames and the corresponding second front sides of the adjacent pair of second rigging frames to pivotally couple the first front sides of the pair of first rigging frames with the corresponding second front sides of the adjacent pair of second rigging frames.

* * * * *

UNITED STATES PATENT AND TRADEMARK OFFICE

CERTIFICATE OF CORRECTION

PATENT NO. : 7,298,860 B2
APPLICATION NO. : 10/407081
DATED : November 20, 2007
INVENTOR(S) : Engebretson et al.

It is certified that error appears in the above-identified patent and that said Letters Patent is hereby corrected as shown below:

IN THE DRAWINGS

Delete the drawing sheets 1-15, and substitute the replace Figs. 1-17 with the attached Replacement Drawings.

Signed and Sealed this

Ninth Day of December, 2008

JON W. DUDAS
*Director of the United States Patent and Trademark Office*